US008473301B2

(12) United States Patent
Chen et al.

(10) Patent No.: US 8,473,301 B2
(45) Date of Patent: Jun. 25, 2013

(54) METHOD AND APPARATUS FOR AUDIO DECODING

(75) Inventors: Zhe Chen, Shenzhen (CN); Fuliang Yin, Shenzhen (CN); Xiaoyu Zhang, Shenzhen (CN); Jinliang Dai, Shenzhen (CN); Libin Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 338 days.

(21) Appl. No.: 12/772,197

(22) Filed: May 1, 2010

(65) Prior Publication Data

US 2010/0228557 A1 Sep. 9, 2010

Related U.S. Application Data

(63) Continuation of application No. PCT/CN2008/072756, filed on Oct. 20, 2008.

(30) Foreign Application Priority Data

| | | |
|---|---|---|
| Nov. 2, 2007 | (CN) | 2007 1 0166745 |
| Nov. 23, 2007 | (CN) | 2007 1 0187437 |
| Mar. 14, 2008 | (CN) | 2008 1 0084725 |

(51) Int. Cl.
*G10L 19/00* (2006.01)
*G10L 21/04* (2006.01)

(52) U.S. Cl.
USPC ..... 704/500; 704/265; 704/262; 704/119

(58) Field of Classification Search
USPC ..... 704/500–502, 265, 262, 219
See application file for complete search history.

(56) References Cited

U.S. PATENT DOCUMENTS

| | | | | |
|---|---|---|---|---|
| 6,704,711 | B2 * | 3/2004 | Gustafsson et al. | 704/258 |
| 7,546,237 | B2 * | 6/2009 | Nongpiur et al. | 704/209 |

(Continued)

FOREIGN PATENT DOCUMENTS

| | | | |
|---|---|---|---|
| CN | 1427989 | A | 7/2003 |
| CN | 1465137 | A | 12/2003 |

(Continued)

OTHER PUBLICATIONS

Office Action in corresponding Russian Application No. 2010122326 (Oct. 20, 2008).

(Continued)

*Primary Examiner* — Pierre-Louis Desir
*Assistant Examiner* — Abdelali Serrou
(74) *Attorney, Agent, or Firm* — Leydig, Voit & Mayer, Ltd.

(57) ABSTRACT

A method for decoding an audio signal includes: obtaining a lower-band signal component of an audio signal corresponding to a received code stream when the audio signal switches from a first bandwidth to a second bandwidth which is narrower than the first bandwidth; extending the lower-band signal component to obtain higher-band information; performing a time-varying fadeout process on the higher-band information to obtain a processed higher-band signal component; and synthesizing the processed higher-band signal component and the obtained lower-band signal component. With the methods provided in the embodiments of the invention, when an audio signal has a switch from broadband to narrowband, a series of processes such as bandwidth detection, artificial band extension, time-varying fadeout process, and bandwidth synthesis, may be performed to make the switch to have a smooth transition from a broadband signal to a narrowband signal so that a comfortable listening experience may be achieved.

4 Claims, 11 Drawing Sheets

U.S. PATENT DOCUMENTS

| | | | | |
|---|---|---|---|---|
| 7,630,881 | B2 * | 12/2009 | Iser et al. | 704/203 |
| 7,734,462 | B2 * | 6/2010 | Kabal et al. | 704/201 |
| 7,792,680 | B2 * | 9/2010 | Iser et al. | 704/500 |
| 8,000,976 | B2 * | 8/2011 | Tashiro et al. | 704/503 |
| 8,069,038 | B2 * | 11/2011 | Malah et al. | 704/205 |
| 8,078,459 | B2 * | 12/2011 | Dai | 704/223 |
| 8,121,831 | B2 * | 2/2012 | Oh et al. | 704/219 |
| 8,249,861 | B2 * | 8/2012 | Li et al. | 704/205 |
| 8,260,611 | B2 * | 9/2012 | Vos et al. | 704/223 |
| 8,265,940 | B2 * | 9/2012 | Geiser et al. | 704/500 |
| 8,364,494 | B2 * | 1/2013 | Vos et al. | 704/500 |
| 2001/0044712 | A1 | 11/2001 | Vainio et al. | |
| 2002/0128839 | A1 * | 9/2002 | Lindgren et al. | 704/258 |
| 2003/0009327 | A1 | 1/2003 | Nilsson et al. | |
| 2003/0093264 | A1 | 5/2003 | Miyasaka et al. | |
| 2003/0093278 | A1 * | 5/2003 | Malah | 704/265 |
| 2003/0093279 | A1 * | 5/2003 | Malah et al. | 704/265 |
| 2004/0028244 | A1 | 2/2004 | Tsushima et al. | |
| 2005/0246164 | A1 | 11/2005 | Ojala et al. | |
| 2007/0239463 | A1 | 10/2007 | Miyasaka et al. | |
| 2009/0176449 | A1 * | 7/2009 | Tashiro | 455/39 |

FOREIGN PATENT DOCUMENTS

| | | | |
|---|---|---|---|
| CN | 1503968 | A | 6/2004 |
| CN | 1511313 | A | 7/2004 |
| CN | 2927247 | Y | 7/2007 |
| GB | 2 357 682 | A | 6/2001 |
| JP | 08-278800 | A | 10/1996 |
| JP | 2000-134162 | A | 5/2000 |
| KR | 2007-0002068 | A | 1/2007 |
| WO | WO 01/48931 | A2 | 7/2001 |
| WO | WO 02/060075 | A2 | 8/2002 |
| WO | WO 2007/010158 | A2 | 1/2007 |
| WO | WO 2007000988 | A1 | 1/2007 |

OTHER PUBLICATIONS

Final Rejection in corresponding Korean Application No. 10-2010-7011060 (Feb. 16, 2012).

Extended Search Report in corresponding European Application No. 08845741.1-1224, mailed Oct. 26, 2010.

Written Opinion of the International Searching Authority in corresponding PCT Application No. PCT/CN2008/072756 (Jan. 15, 2009).

International Search Report in corresponding PCT Application No. PCT/CN2008/072756 (Jan. 15, 2009).

Office Action in corresponding European Application No. 08845741.1 (Sep. 8, 2011).

"G-729.1-G.729-based embedded variable bit-rate coder: An 8-32 kbit/s scalable wideband coder bitstream interoperable with G.729," May 2006, Series G: Transmission Systems and Media, Digital Systems and Networks, International Telecommunication Union, Geneva, Switzerland.

"G.729—Coding of Speech at 8kbit/s Using Conjugate-Structure Algebraic-Code-Excited Linear-Prediction (CS-ACELP)," Mar. 1996, General Aspects of Digital Transmission Systems, International Telecommunication Union, Geneva, Switzerland.

Office Action in corresponding Korean Application No. 20107011060 (Jun. 29, 2011).

International Telecommunications Union, "Series G: Transmission Systems and Media, Digital Systems And Networks: Digital terminal equipments—Coding of analogue signals by methods other than PCM," ITU-T G.729.1 (May 2006).

1st Office Action in corresponding Japanese Application No. 2010-532409 (Apr. 17, 2012).

Summons to Attend Oral Proceedings in corresponding European Patent Application No. 08845741.1 (Jul. 9, 2012).

* cited by examiner

METHOD AND APPARATUS FOR AUDIO DECODING

CROSS REFERENCE TO RELATED APPLICATIONS

This application is a continuation of International Application No. PCT/CN2008/072756, filed on Oct. 20, 2008, which claims priority to Chinese Patent Application No. 200710166745.5, filed on Nov. 2, 2007, Chinese Patent Application No. 200710187437.0, filed on Nov. 23, 2007, and Chinese Patent Application No. 200810084725.8, filed on Mar. 14, 2008, all of which are hereby incorporated by reference in their entireties.

FIELD OF THE INVENTION

The disclosure relates to the field of voice communications, and more particularly, to a method and apparatus for audio decoding.

BACKGROUND

G.729.1 is a new-generation speech encoding and decoding standard newly released by the International Telecommunication Union (ITU). This embedded speech encoding and decoding standard is best characterized in having a feature of layered encoding, which may provide an audio quality from narrowband to broadband within a rate range of 8 kb/s~32 kb/s. During the transmission process, an outer-layer code stream may be discarded depending on the channel condition and thus good channel adaptation may be achieved.

In the G.729.1 standard, the feature of layering is achieved by formulating a code stream into an embedded layered structure, and thus a novel embedded layered multi-rate speech codec is needed. With a 20 ms super-frame being input, when the sampling rate is 16000 Hz, the length of the frame is 320 points. FIG. 1 is a block diagram of a G.729.1 system with encoders at each layer. The speech codec has a specific encoding process as follows. First, an input signal $s_{WB}(n)$ is divided by a Quadrature Mirror Filterbank (QMF) into two sub-bands ($H_1(z)$, $H_2(z)$). The lower sub-band signal $s_{LB}^{qmf}(n)$ is pre-processed at a high pass filter having a cut-off frequency of 50 Hz. The output signal $s_{LB}(n)$ is encoded by an 8 kb/s~12 kb/s narrowband embedded Code-Excited Linear-Prediction (CELP) encoder. The difference signal $d_{LB}(n)$ between $s_{LB}(n)$ and a local synthesis signal $\hat{s}_{enh}(n)$ of the CELP encoder at the rate of 12 Kb/s passes through a sense weighting filter ($W_{LB}(z)$) to obtain a signal $d_{LB}^{w}(n)$. The signal $d_{LB}^{w}(n)$ is subject to a Modified Discrete Cosine Transform (MDCT) to the frequency-domain. The weighting filter $W_{LB}(z)$ includes gain compensation, to maintain spectral continuity between the output signal $d_{LB}^{w}(n)$ of the filter and the higher sub-band input signal $s_{HB}(n)$. The weighted difference signal is transformed to the frequency-domain.

The higher sub-band component is multiplied with $(-1)^n$ to obtain a spectrally inverted signal $s_{HB}^{fold}(n)$. The spectrally inverted signal $s_{HB}^{fold}(n)$ is pre-processed after passing through a low pass filter having a cut-off frequency of 3000 HZ. The filtered signal $s_{HB}(n)$ is encoded at a Time-Domain BandWidth Extension (TDBWE) encoder. An MDCT transform is performed on $s_{HB}(n)$ to the frequency-domain before it enters the Time-domain Alias Cancellation (TDAC) encoding module.

Finally, two sets of MDCT coefficients $D_{LB}^{w}(k)$ and $S_{HB}(k)$ are encoded with a TDAC encoding algorithm. In addition, some other parameters are transmitted by the Frame Erasure Concealment (FEC) encoder to improve over the errors caused when frame loss occurs during transmission.

FIG. 2 is the block diagram of a G.729.1 system having decoders at each layer. The operation mode of the decoder is determined by the number of layers of the received code stream, or equivalently, the receiving rate. Detailed descriptions will be made to various cases based on different receiving rates at the receiving side.

1. If the receiving rate is 8 kb/s or 12 kb/s (i.e., only the first layer or the first two layers are received), an embedded CELP decoder decodes the code stream of the first layer or the first two layers, obtains a decoded signal $\hat{s}_{LB}(n)$, and performs a post-filtering to obtain $\hat{s}_{LB}^{post}(n)$, which passes through a high pass filter to reach a QMF filter bank. A 16 kHz broadband signal is synthesized, having a higher-band signal component set to 0.

2. If the receiving rate is 14 kb/s (i.e., the first three layers are received), besides the CELP decoder decodes the narrowband component, the TDBWE decoder decodes the higher-band signal component $\hat{s}_{HB}^{bwe}(n)$. An MDCT transform is performed on $\hat{s}_{HB}^{bwe}(n)$, the frequency components higher than 3000 Hz in the higher sub-band component spectrum (corresponding to higher than 7000 Hz in the 16 kHz sampling rate) are set to 0, and then an inverse MDCT transform is performed. After superimposition and spectrum inversion, the processed higher-band component is synthesized in the QMF filter bank with the lower-band component $\hat{s}_{LB}^{post}(n)$ decoded by the CELP decoder, to obtain a broadband signal having a sampling rate of 16 kHz.

3. If the received code stream has a rate of higher than 14 kb/s (corresponding to the first four layers or more layers), besides the CELP decoder obtains the lower sub-band component $\hat{s}_{LB}^{post}(n)$ by decoding and the TDBWE decoder obtains the higher sub-band component $\hat{s}_{HB}^{bwe}(n)$ by decoding, the TDAC decoder obtains a lower sub-band weighting differential signal and a higher sub-band enhancement signal by decoding. The full band signal is enhanced and finally a broadband signal having a sampling rate of 16 kHz is synthesized in the QMF filter bank.

Conventional systems have at least the following deficiencies.

A G.729.1 code stream has a layered structure. During the transmission process, outer-layer code streams may be discarded from the outer to the inner depending on the channel transmission capability, and thus adaptation to the channel condition may be achieved. From the description to the encoding and decoding algorithms, it can be seen that when the channel capacity has a fast change over time, the decoder might receive a narrowband code stream (equal to or lower than 12 kb/s) at a moment when the decoded signal only contains components lower than 4000 Hz and the decoder might receive a broadband code stream (equal to or higher than 14 kb/s) at another moment when the decoded signal may contain a broadband signal of 0~7000 Hz. Such a sudden change in bandwidth is referred to as bandwidth switch herein. Since contributions from higher and lower bands to the listening experience are different, such frequent switches may bring noticeable discomfort to the listening experience. In particular, when there are frequent broadband-to-narrowband switches, one will frequently feel that the voice jumps from clearness to tediousness. Therefore, there is a need for a technique to mitigate the discomfort caused by the frequent switches to the listening experience.

SUMMARY

The disclosure provides an audio decoding method and apparatus, to improve over the comfort felt by the human being when a bandwidth switch occurs to a speech signal.

To achieve the above object, an embodiment of the invention provides an audio decoding method, including:

obtaining a lower-band signal component of an audio signal corresponding to a received code stream when the audio signal switches from a first bandwidth to a second bandwidth which is narrower than the first bandwidth;

extending the lower-band signal component to obtain higher-band information;

performing a time-varying fadeout process on the higher-band information obtained through extension to obtain a processed higher-band signal component; and synthesizing the processed higher-band signal component and the obtained lower-band signal component.

Also, an embodiment of the invention provides an audio decoding apparatus, including an obtaining unit, an extending unit, a time-varying fadeout processing unit, and a synthesizing unit.

The obtaining unit is configured to obtain a lower-band signal component of an audio signal corresponding to a received code stream when the audio signal switches from a first bandwidth to a second bandwidth which is narrower than the first bandwidth, and transmit the lower-band signal component to the extending unit.

The extending unit is configured to extend the lower-band signal component to obtain higher-band information, and transmit the higher-band information obtained through extension to the time-varying fadeout processing unit.

The time-varying fadeout processing unit is configured to perform a time-varying fadeout process on the higher-band information obtained through extension to obtain a processed higher-band signal component, and transmit the processed higher-band signal component to the synthesizing unit.

The synthesizing unit is configured to synthesize the received processed higher-band signal component and the lower-band signal component obtained by the obtaining unit.

Compared with conventional systems, the following advantageous effects may be achieved in the embodiments of the invention.

With the methods provided in the embodiments of the invention, when an audio signal has a switch from broadband to narrowband, a series of processes such as artificial band extension, time-varying fadeout process, and bandwidth synthesis, may be performed to make the switch to have a smooth transition from a broadband signal to a narrowband signal so that a comfortable listening experience may be achieved.

DETAILED DESCRIPTION

Further detailed descriptions will be made to the implementation of the invention with reference to specific embodiments and the accompanying drawings.

Figure 3:
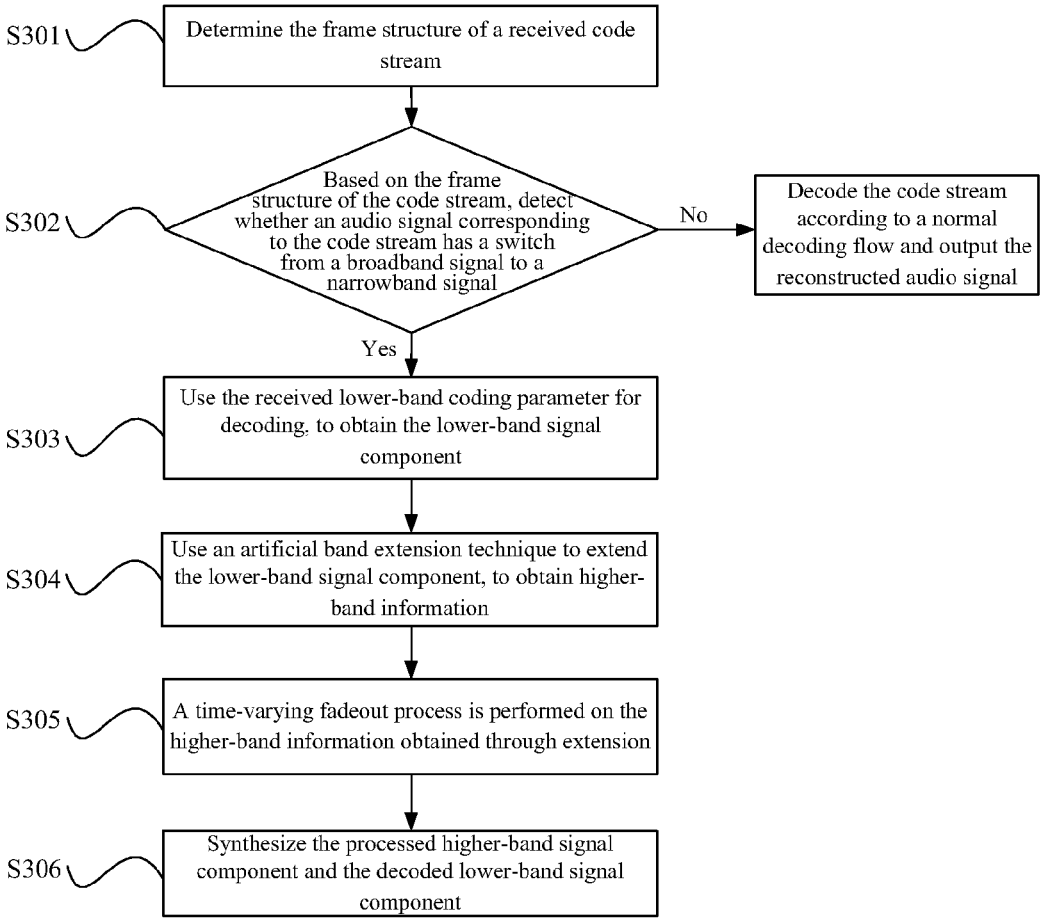
FIG. 3 is a flow chart of a method for decoding an audio signal in a first embodiment of the invention.

In a first embodiment of the invention, a method for decoding an audio signal is shown in FIG. 3. Specific steps are included as follows.

In step S301, the frame structure of a received code stream is determined.

In step S302, based on the frame structure of the code stream, detection is made as to whether an audio signal corresponding to the code stream has a switch from a first bandwidth to a second bandwidth which is narrower than the first bandwidth. If there is such a switch, step S303 is performed. Otherwise, the code stream is decoded according to a normal decoding flow and the reconstructed audio signal is output.

In the speech encoding and decoding field, a narrowband signal generally refers to a signal having a frequency band of 0~4000 Hz and a broadband signal refers to a signal having a frequency band of 0~8000 Hz. An ultra wideband (UWB) signal refers to a signal having a frequency band of 0~16000 Hz. A signal having a wider band may be divided into a lower-band signal component and a higher-band signal component. Of course, the above definitions are just common and practical applications are not limited in this respect. For ease of illustration, the higher-band signal component in the embodiments of the invention may refer to the part added after the switch with respect to the bandwidth before the switch, and the narrowband signal component may refer to the part having a bandwidth common to both the audio signals before and after the switch. For example, when a switch occurs from a signal having a band of 0~8000 Hz to a signal having a band of 0~4000 Hz, the lower-band signal component may refer to the signal of 0~4000 Hz and the higher-band signal component may refer to the signal of 4000~8000 Hz.

In step S303, when detecting that the audio signal corresponding to the code stream switches from the first bandwidth to the second bandwidth, the received lower-band coding parameter is used for decoding, to obtain a lower-band signal component.

In an embodiment of the invention, the solution in the embodiments of the invention may be applied as long as the bandwidth before the switch is wider than the bandwidth after the switch, and it is not limited to a broadband-to-narrowband switch in the general sense.

In step S304, an artificial band extension technique is used to extend the lower-band signal component, so as to obtain higher-band information.

Specifically, the higher-band information may be a higher-band signal component or a higher-band coding parameter.

During the initial time period when the audio signal corresponding to the code stream switches from the first bandwidth to the second bandwidth, there may be two methods for extending the lower-band signal component to obtain the higher-band information with the artificial band extension technique. Specifically, a higher-band coding parameter received before the switch may be used to extend the lower-band signal component to obtain higher-band information; or, a lower-band signal component decoded from the current audio frame after the switch may be extended to obtain higher-band information.

The method of employing a higher-band coding parameter received before the switch to extend the lower-band signal component to obtain higher-band information may include: buffering a higher-band coding parameter received before the switch (for example, the time-domain and frequency-domain envelopes in the TDBWE encoding algorithm or the MDCT coefficients in the TDAC encoding algorithm); and estimating the higher-band coding parameter of the current audio frame by using extrapolation after the switch. Further, according to the higher-band coding parameter, a corresponding broadband decoding algorithm may be used to obtain the higher-band signal component.

The method of employing a lower-band signal component decoded from the current audio frame after the switch to obtain higher-band information may include: performing a Fast Fourier Transform (FFT) on the lower-band signal component decoded from the current audio frame after the switch; extending and shaping the FFT coefficients of the lower-band signal component within the FFT domain, the shaped FFT coefficients as the FFT coefficients of the higher-band information; performing an inverse FFT transform, to obtain the higher-band signal component. Of course, the computation complexity of the former method is much lower than the latter method. In the following embodiments, for example, the former method is employed to describe the invention.

In S305, a time-varying fadeout process is performed on the higher-band information obtained through extension.

Specifically, after the higher-band information is obtained through extension by using the artificial band extension technique, QMF filtering is not performed to synthesize the higher-band information and the lower-band signal component into a broadband signal. Rather, a time-varying fadeout process is performed on the higher-band information obtained through extension. The fadeout process refers to the transition of the audio signal from the first bandwidth to the second bandwidth. The method of performing a time-varying fadeout process on the higher-band information may include a separate time-varying fadeout process and a hybrid time-varying fadeout process.

Specifically, the separate time-varying fadeout process may involve a first method in which a time-domain shaping is performed on the higher-band information obtained through extension by using a time-domain gain factor and further a frequency-domain shaping may be performed on the time-domain shaped higher-band information by using time-varying filtering; or a second method in which a frequency-domain shaping is performed on the higher-band information obtained through extension by using time-varying filtering and further a time-domain shaping may be performed on the frequency-domain shaped higher-band information by using a time-domain gain factor.

Specifically, the hybrid time-varying fadeout process may involve a third method in which a frequency-domain shaping is performed on the higher-band coding parameter obtained through extension by using a frequency-domain higher-band parameter time-varying weighting method, to obtain a time-varying fadeout spectral envelope, and the processed higher-band signal component is obtained through decoding; or a fourth method in which the higher-band signal component obtained through extension is divided into sub-bands, and a frequency-domain higher-band parameter time-varying weighting is performed on the coding parameter of each sub-band to obtain a time-varying fadeout spectral envelope and the processed higher-band signal component is obtained through decoding.

In step S306, the processed higher-band signal component and the decoded lower-band signal component are synthesized.

In the above steps, the decoder may perform the time-varying fadeout process on the higher-band information obtained through extension in many methods. Detailed descriptions will be made below to the specific embodiments of different time-varying fadeout processing method.

In the following embodiments, the code stream received by the decoder may be a speech segment. The speech segment refers to a segment of speech frames received by the decoder consecutively. A speech frame may be a full rate speech frame or several layers of the full rate speech frame. Alternatively, the code stream received by the decoder may be a noise segment which refers to a segment of noise frames received by the decoder consecutively. A noise frame may be a full rate noise frame or several layers of the full rate noise frame.

Figure 4:
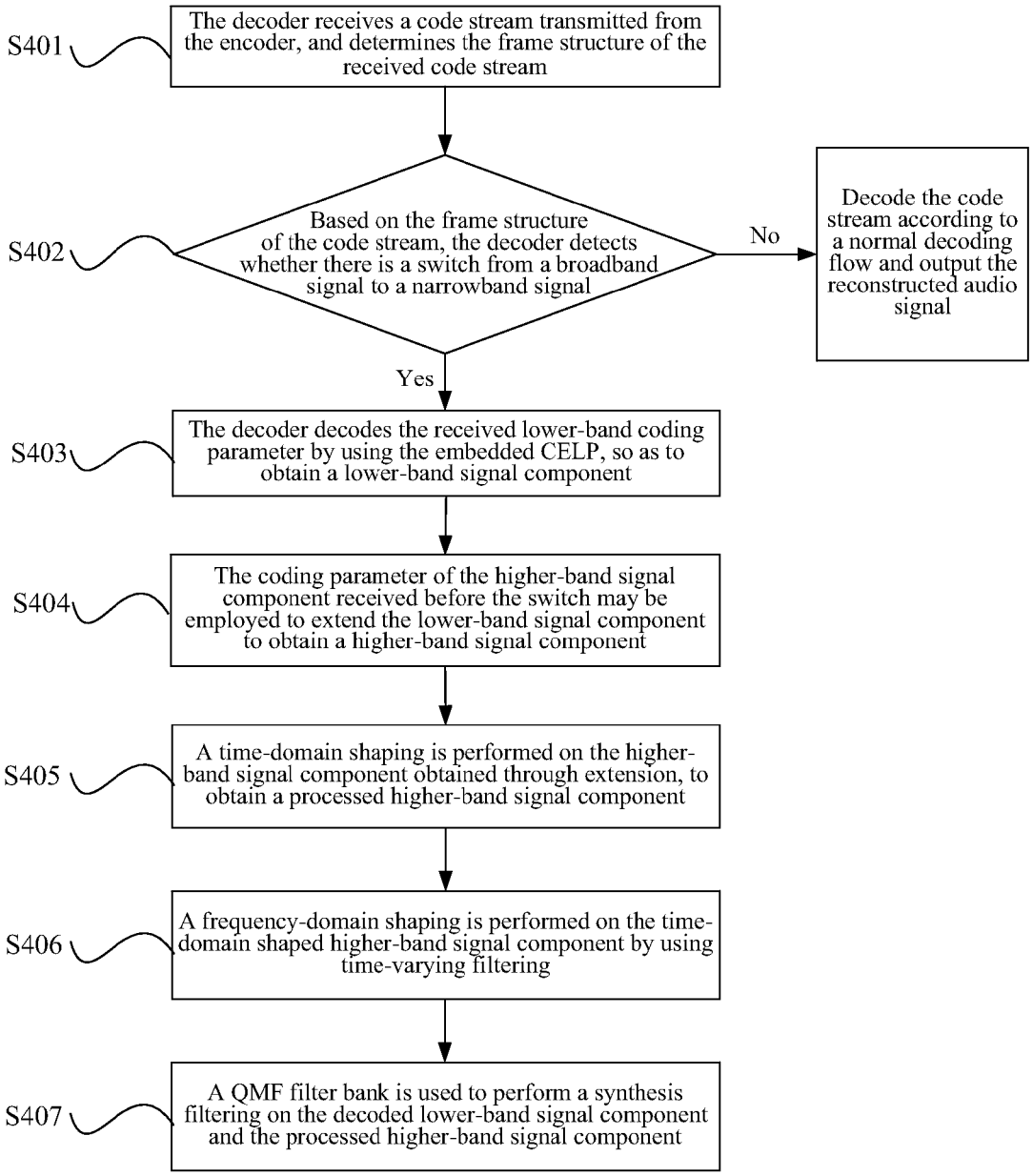
FIG. 4 is a flow chart of a method for decoding an audio signal in a second embodiment of the invention.

In the second embodiment of the invention, for example, the code stream received by the decoder is a speech segment and the time-varying fadeout process uses the first method. In other words, a time-domain shaping is performed on the higher-band information obtained through extension by using a time-domain gain factor and further a frequency-domain shaping may be performed on the time-domain shaped higher-band information by using time-varying filtering. A method for decoding an audio signal is shown in FIG. 4, and may include specific steps as follows.

In step S401, the decoder receives a code stream transmitted from the encoder, and determines the frame structure of the received code stream.

Figure 1:
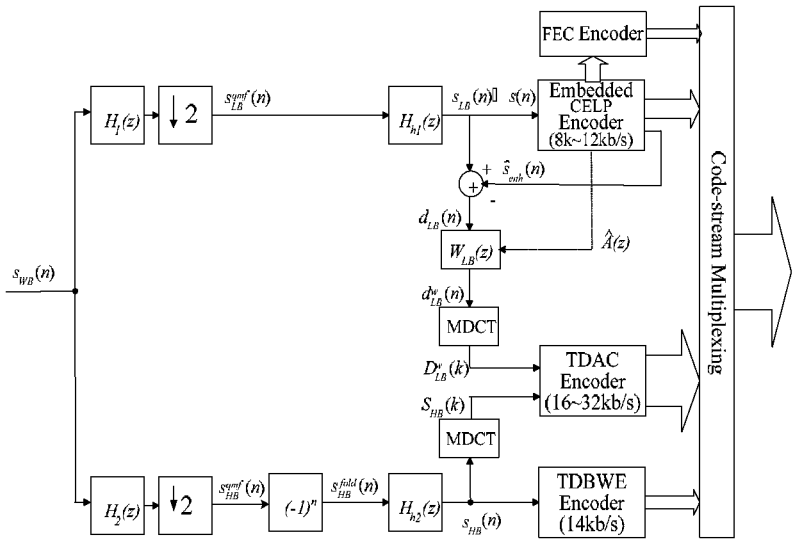
FIG.1 (Prior Art)
FIG. 1 is a block diagram of a conventional G.729.1 encoder system.
Figure 2:
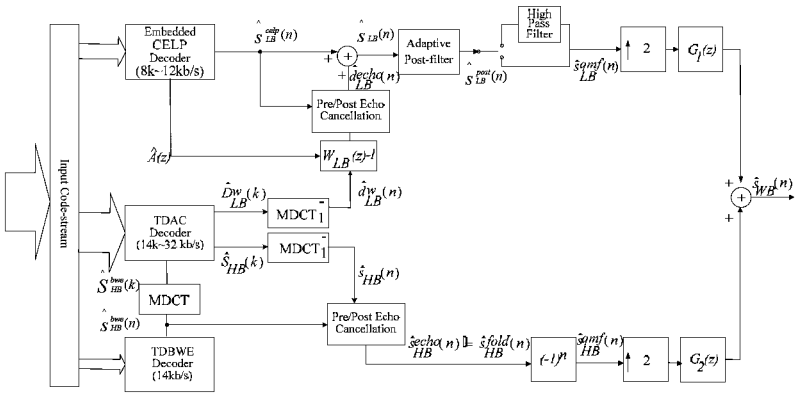
FIG.2 (Prior Art)
FIG. 2 is a block diagram of a conventional G.729.1 decoder system.
Figure 2:
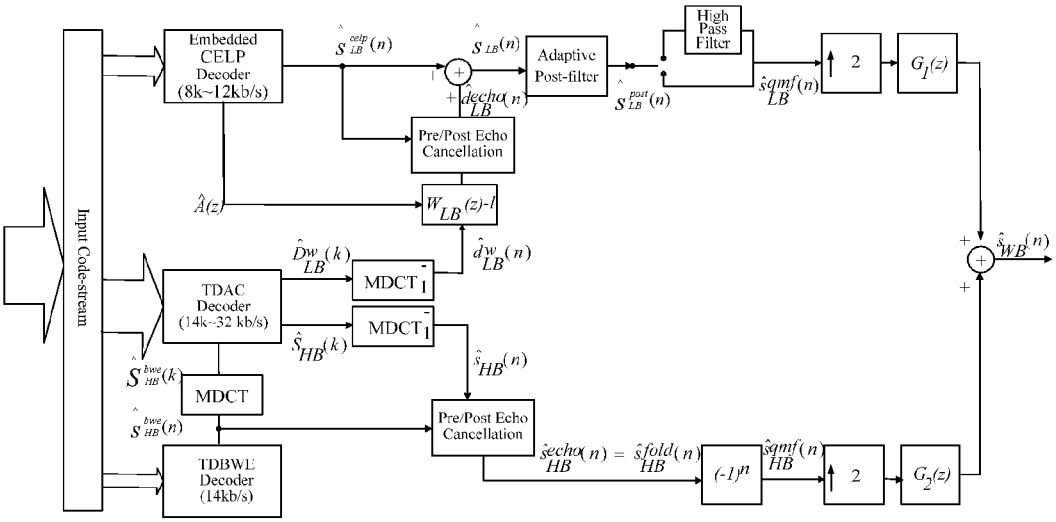

Specifically, the encoder encodes the audio signal according to the flow as shown in the systematic block diagram of FIG. 1, and transmits the code stream to the decoder. The decoder receives the code stream. If the audio signal corresponding to the code stream has no switch from broadband to narrowband, the decoder may decode the received code stream as normal according to the flow shown in the systematic block diagram of FIG. 2. No repetition is made here. The code stream received by decoder is a speech segment. A speech frame in the speech segment may be a full rate speech frame or several layers of the full rate speech frame. In this embodiment, a full rate speech frame is used and its frame structure is shown in Table 1.

TABLE 1

| | 10 ms frame 1 | | 10 ms frame 2 | | Total |
|---|---|---|---|---|---|
| | LSP | | | | |
| | 18 | | 18 | | |
| | sub-frame1 | sub-frame2 | sub-frame1 | sub-frame2 | 36 |
| Layer 1 - core layer (narrowband embedded CELP) | | | | | |
| Adaptive codebook delay | 8 | 5 | 8 | 5 | 26 |
| Fundamental tone delay parity check | 1 | | 1 | | 2 |
| Fixed codebook index | 13 | 13 | 13 | 13 | 52 |
| Fixed codebook symbol | 4 | 4 | 4 | 4 | 16 |
| Codebook gain (Level 1) | 3 | 3 | 3 | 3 | 12 |
| Codebook gain (Level 2) | 4 | 4 | 4 | 4 | 16 |
| 8 kb/s core layers in total | 160 | | | | |
| Layer 2 - narrowband enhancement layer (narrowband embedded CELP) | | | | | |
| Level 2 fixed codebook index | 13 | 13 | 13 | 13 | 52 |
| Level 2 fixed codebook symbol | 4 | 4 | 4 | 4 | 16 |
| Level 2 fixed codebook gain | 3 | 2 | 3 | 2 | 10 |
| Error correction bits (class info) | | 1 | | 1 | 2 |
| 12 kb/s enhancement layers in total | 80 | | | | |
| Layer 3 - broadband enhancement layer (TDBWE) | | | | | |
| Time-domain envelope average | 5 | | | | 5 |
| Time-domain envelope split vector | 7 + 7 | | | | 14 |
| Frequency-domain envelope split vector | 5 + 5 + 4 | | | | 14 |
| Error correction bits (phase info) | 7 | | | | 7 |
| 14 kb/s enhancement layers in total | 40 | | | | |
| Layer 4 to layer 12 - broadband enhancement layer (TDAC) | | | | | |
| Error correction bits (energy info) | 5 | | | | 5 |
| MDCT normalized factor | 4 | | | | 4 |
| Higher-band spectral envelope | nbits_HB | | | | nbits_HB |
| Lower-band spectral envelope | nbits_LB | | | | nbits_LB |
| Fine structure | nbits_VQ = 351 − nbits_HB − nbits_LB | | | | nbits_VQ |
| 16~32 kb/s enhancement layers in total | 360 | | | | |
| Total | 640 | | | | |

In step S402, the decoder detects whether a switch from broadband to narrowband occurs according to the frame structure of the code stream. If such a switch occurs, the flow proceeds with step S403. Otherwise, the code stream is decoded according to the normal decoding flow and the reconstructed audio signal is output.

If a speech frame is received, a determination may be made as to whether a switch from broadband to narrowband occurs according to the data length or the decoding rate of the current frame. For example, if the current frame only contains data of layer 1 and layer 2, the length of the current frame is 160 bits (i.e., the decoding rate is 8 kb/s) or 240 bits (i.e., the decoding rate is 12 kb/s), and thus the current frame is narrowband. Otherwise, if the current frame contains data of the first two layers as well as data of higher layers, that is, the length of the current frame is equal to or more than 280 bits (i.e., the decoding rate is 14 kb/s), the current frame is broadband.

Specifically, based on the bandwidth of the speech signal determined from the current frame and the previous frame or frames, detection may be made as to whether the current speech segment has a switch from broadband to narrowband.

In step S403, when the speech signal corresponding to the received code stream switches from broadband to narrowband, the decoder decodes the received lower-band coding parameter by using the embedded CELP, so as to obtain a lower-band signal component $\hat{s}_{LB}^{post}(n)$.

In step S404, the coding parameter of the higher-band signal component received before the switch may be employed to extend the lower-band signal component $\hat{s}_{LB}^{post}(n)$, so as to obtain a higher-band signal component $\hat{s}_{HB}(n)$.

Specifically, after receiving a speech frame having a higher-band coding parameter, the decoder buffers the TDBWE coding parameter (including the time-domain envelope and the frequency-domain envelope) of M speech frames received before the switch each time. After detecting a switch from broadband to narrowband, the decoder first extrapolates the time-domain envelope and frequency-domain envelope of the current frame based on the time-domain envelope and frequency-domain envelope of the speech frames received before the switch stored in the buffer, and then performs TDBWE decoding by using the extrapolated time-domain envelope and frequency-domain envelope to obtain the higher-band signal component through extension. Also, the decoder may buffer the TDAC coding parameter of M speech frames received before the switch (i.e., the MDCT coefficients), extrapolates the MDCT coefficients of the current frame, and then performs TDAC decoding by using the extrapolated MDCT coefficients to obtain the higher-band signal component through extension.

Upon detection of a switch from broadband to narrowband, for a speech frame lacking any higher-band coding parameter, the synthesis parameter of the higher-band signal component may be estimated with a mirror interpolation method. In other words, the higher-band coding parameters of the M recent speech frames buffered in the buffer are used as a mirror source to perform a segment linear interpolation, starting from the current speech frame. The equation for segment linear interpolation is:

$$P_k = \begin{cases} P_{-1} & k = 0 \\ \frac{[k(M-1)]\mathrm{mod}(N-1)}{N-1} P_{-\lfloor k/M+1 \rfloor} + \left(1 - \frac{[k(M-1)]\mathrm{mod}(N-1)}{N-1}\right) P_{-\lfloor k/M+2 \rfloor} & k > 0 \end{cases} \quad (1)$$

In the above formula, $P_k$ represents the synthesis parameter for higher-band signal component of the $k^{th}$ speech frame reconstructed from the switching position, with k=0, . . . , N−1, N is the number of speech frames for which the fadeout process is performed, $P_{-i}$ represents the higher-band coding parameter of the $i^{th}$ speech frame received before the switching position stored in the buffer, i=1, . . . , M, M is the number of frames buffered for the fadeout process, (a) mod (b) represents a MOD operation of a with b, and ⌊●⌋ represents a floor operation. According to equation (1), the higher-band coding parameters of M buffered speech frames before the switch may be used to estimate the higher-band coding parameters of N speech frames after the switch. The higher-band signal components of N speech frames after the switch may be reconstructed with a TDBWE or TDAC decoding algorithm. According to the requirements in practical applications, M may be any value less than N.

In step S405, a time-domain shaping is performed on the higher-band signal component obtained through extension $\hat{s}_{HB}(n)$, to obtain a processed higher-band signal component $\hat{s}_{HB}^{ts}(n)$.

Figure 5:
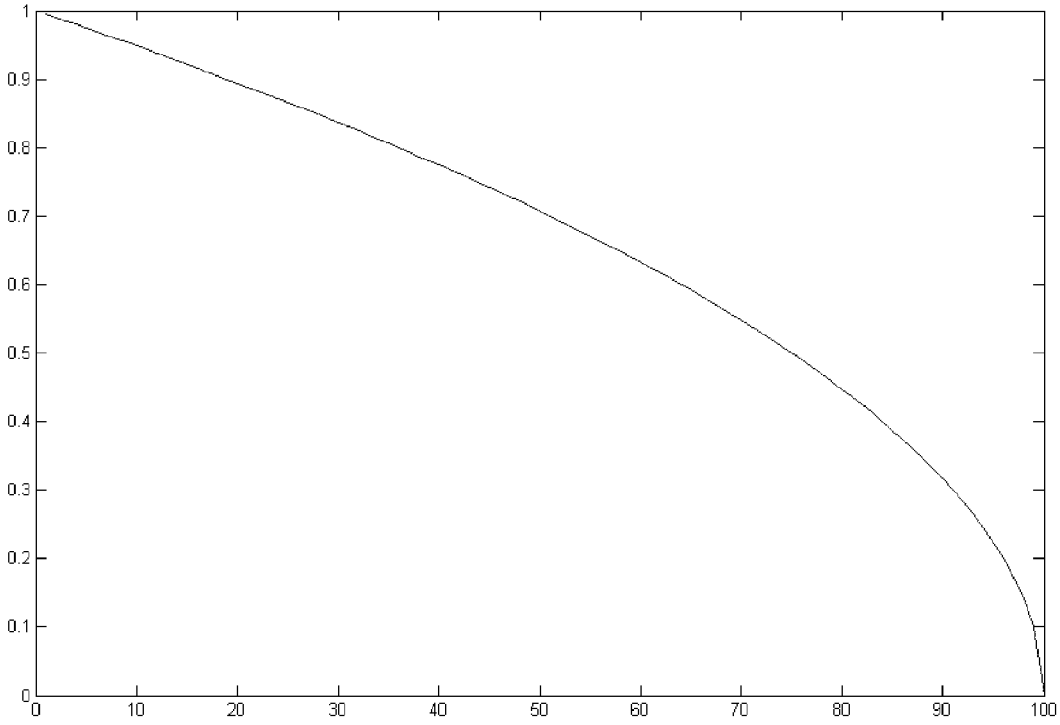
FIG. 5 shows the changing curve for the time-varying gain factor in the second embodiment of the invention.

Specifically, when the time-domain shaping is being performed, a time-varying gain factor g(k) may be introduced. The changing curve of the time-varying factor is shown in FIG. 5. The time-varying gain factor has a linearly attenuated curve in the logarithm domain. For the $k^{th}$ speech frame occurring after the switch, the higher-band signal component obtained through extension is multiplied with the time-varying gain factor, as shown in equation (2):

$$\hat{s}_{HB}^{ts}(n)=g(k)\cdot\hat{s}_{HB}(n) \quad (2)$$

where n=0, . . . , L−1; k=0, . . . , N−1, and L represents the length of the frame.

In step S406, optionally, a frequency-domain shaping may be performed on the time-domain shaped higher-band signal component $\hat{s}_{HB}^{ts}(n)$ by using time-varying filtering, to obtain the frequency-domain shaped higher-band signal component $\hat{s}_{HB}^{fad}(n)$.

Figure 6:
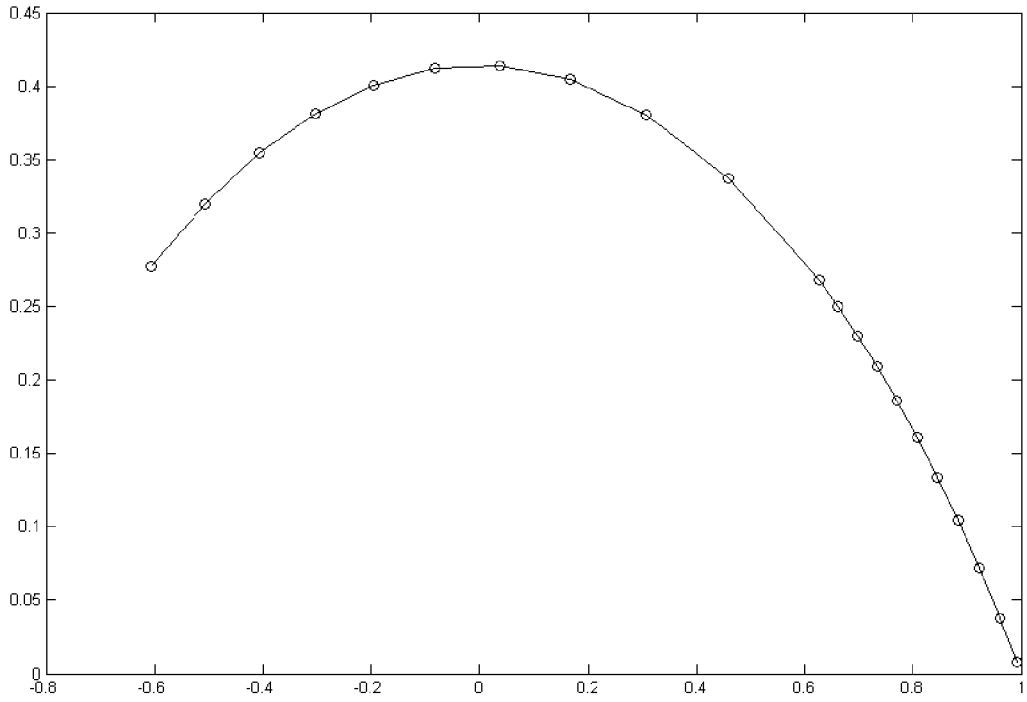
FIG. 6 shows the change in the pole point of the time-varying filter in the second embodiment of the invention.

Specifically, the time-domain shaped higher-band signal component $s_{HB}^{ts}(n)$ passes through a time-varying filter so that the frequency band of the higher-band signal component becomes narrower slowly over time. The time-varying filter used in this embodiment is a time-varying order 2 Butterworth filter having a zero point fixed at −1 and a pole point changing constantly. FIG. 6 shows the change in the pole point of the time-varying order 2 Butterworth filter. The pole point of the time-varying filter moves clockwise. In other words, the pass band of the filter decreases until to reach 0.

When the decoder processes a 14 kb/s or higher speech signal, the broadband-to-narrowband switching flag fad_out_flag is set to 0, and the counter of the points of the filter fad_out_count is set to 0. Starting from a certain moment, when the decoder starts to process an 8 kb/s or 12 kb/s speech signal, the narrowband-to-broadband switching flag fad_out_flag is set to 1, and the time-varying filter is enabled to start filtering the reconstructed higher-band signal component. When the number of points of the filter fad_out_count meets the condition fad_out_count<FAD_OUT_COUNT_MAX, time-varying filtering is performed continuously. Otherwise, the time-varying filter process is stopped. Here, FAD_OUT_COUNT_MAX=N×L is the number of transitions (for example, FAD_OUT_COUNT_MAX=8000).

It is assumed that the time-varying filter has a precise pole point of rel(i)+img(i)×j at moment i and the pole point moves to rel(m)+img(m)×j precisely at moment m. If the point number of interpolation is N, the interpolation result at moment k is:

$$rel(k)=rel(i)\times(N-k)/N+rel(m)\times k/N$$

$$img(k)=img(i)\times(N-k)/N+img(m)\times k/N$$

The interpolation pole point may be used to recover the filter coefficients at moment k, and a transfer function may be obtained:

$$H(z) = \frac{1 + 2z^{-1} + z^{-2}}{1 - 2rel(k)z^{-1} + [rel^2(k) + img^2(k)]z^{-2}}$$

When the decoder receives a broadband speech signal, the counter of the points of the filter fad_out_count is set to 0. When the speech signal received by the decoder switches from broadband to narrowband, the time-varying filter is enabled, and the filter counter may be updated as follows:

fad_out_count=min(fad_out_count+1,FAD_OUT_COUNT_MAX), where FAD_OUT_COUNT_MAX is the number of successive samples during the transition phase.

Let $a_1$=2rel(k) and $a_2$=−[$rel^2$ (k)+$img^2$ (k)]. The time-domain shaped reconstructed higher-band signal component $\hat{s}_{HB}^{ts}(n)$ is the input signal of the time-varying filter, and $\hat{s}_{HB}^{fad}(n)$ is the output signal of the time-varying filter.

$$\hat{s}_{HB}^{fad}(n)=\text{gain_filter}\times[a_1\times\hat{s}_{HB}^{fad}(n-1)+a_2\times\hat{s}_{HB}^{fad}(n-2)+\hat{s}_{HB}^{ts}+2.0\times\hat{s}_{HB}^{ts}(n-1)+\hat{s}_{HB}^{ts}(n-2)]$$

where gain_filter is the filter gain and its computing equation is:

$$\text{gain_filter}=\frac{1-a_1-a_2}{4}$$

In step S407, a QMF filter bank may be used to perform a synthesis filtering on the decoded lower-band signal component $\hat{s}_{LB}^{post}(n)$ and the processed higher-band signal component $\hat{s}_{HB}^{fad}(n)$ (the higher-band signal component $\hat{s}_{HB}^{ts}(n)$ if step S406 is not performed). Thus, a time-varying fadeout signal may be reconstructed, which meets the characteristics of a smooth transition from broadband to narrowband.

The time-varying fadeout processed higher-band signal component $\hat{s}_{HB}^{fad}(n)$ and the reconstructed lower-band signal component $\hat{s}_{LB}^{post}(n)$ are input together to the QMF filter bank for synthesis filtering, to obtain a full band reconstructed signal. Even if there are frequent switches from broadband to narrowband during decoding, the reconstructed signal processed according to the invention can provide a relatively better listening quality to the human beings.

Figure 7:
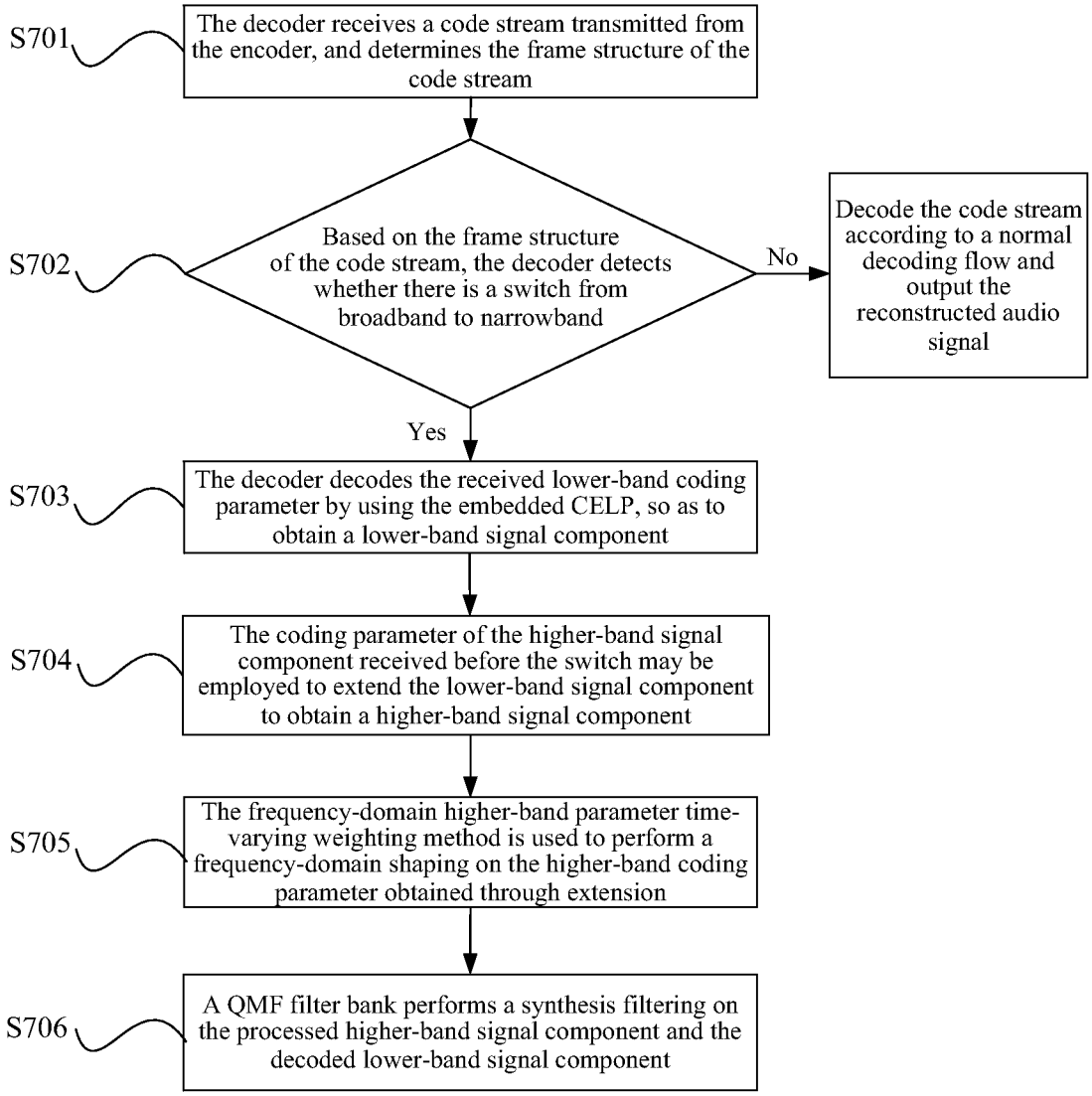
FIG. 7 is a flow chart of a method for decoding an audio signal in a third embodiment of the invention.

In this embodiment, for example, the time-varying fadeout process of the speech segment uses the first method, that is, a time-domain shaping is performed on the higher-band information obtained through extension by using a time-domain gain factor, and a frequency-domain shaping is performed on the time-domain shaped higher-band information by using time-varying filtering. It may be understood that the time-varying fadeout process may use other alternative methods. In the third embodiment of the invention, for example, the code stream received by the decoder is a speech segment and the time-varying fadeout process uses the third method, that is, a frequency-domain higher-band parameter time-varying weighting method is used to perform a frequency-domain shaping on the higher-band information obtained through extension. A method for decoding an audio signal is shown in FIG. 7, including steps as follows.

Steps S701-S703 are similar to steps S401-S403 in the second embodiment, and thus no repetition is made here.

In step S704, the coding parameter of a higher-band signal component received before the switch is used to extend the lower-band signal component $\hat{s}_{LB}^{post}(n)$, to obtain the higher-band coding parameter.

In this process, the higher-band coding parameter of M speech frames before the switch buffered in the decoder may be used to estimate the higher-band coding parameter of N speech frames after the switch (the frequency-domain envelope and the higher-band spectral envelope). Specifically, after the decoder receives a frame containing a higher-band coding parameter, the TDBWE coding parameters of the M speech frames received before the switch may be buffered each time, including coding parameters such as the time-domain envelope and the frequency-domain envelope. Upon detection of a switch from broadband to narrowband, the decoder first obtains the time-domain envelope and the frequency-domain envelope of the current frame through extrapolation based on the time-domain envelope and the frequency-domain envelope received before the switch stored in the buffer. Alternatively, the decoder may buffer the TDAC coding parameter (i.e., MDCT coefficients) of the M speech frames received before the switch, and obtains the higher-band coding parameter through extension based on the MDCT coefficients of the speech frame.

Upon detection of a switch from broadband to narrowband, for a frame lacking any higher-band coding parameter, a mirror interpolation method may be used to estimate the synthesis parameter of the higher-band signal component. Specifically, by taking the higher-band coding parameter (frequency-domain envelope and higher-band spectral envelope) of the M (for example, M=5) recent speech frames buffered in the buffer as a mirror source, a segment linear interpolation is performed starting from the current speech frame. This may be implemented by using the segment linear interpolation equation (1) in the second embodiment, where the number of successive frames is N (for example, N=50). In this process, the buffered higher-band coding parameters of the M frames before the switch may be used to estimate the higher-band coding parameters (frequency-domain envelope and higher-band spectral envelope) of the N frames after the switch.

In step S705, a frequency-domain higher-band parameter time-varying weighting method may be used to perform a frequency-domain shaping on the higher-band coding parameter obtained through extension.

Specifically, the higher-band signal is divided into several sub-bands in the frequency-domain, and then a frequency-domain weighting is performed on the higher-band coding parameter of each sub-band with a different gain so that the frequency band of the higher-band signal component becomes narrower slowly. The broadband coding parameter, no matter the frequency-domain envelope in the TDBWE encoding algorithm at 14 kb/s or the higher-band envelope in the TDAC encoding algorithm at a rate of more than 14 kb/s, may imply a process of dividing the higher-band into a number of sub-bands. Therefore, if a time-varying fadeout process is performed directly on the received higher-band coding parameter within the frequency-domain, more computation complexity may be saved as compared to the method of using a filter within the time-domain. When the decoder processes a speech signal having a rate of 14 kb/s or higher, the narrowband-to-broadband switching flag fad_out_flag is set to 0, and the counter of transition frames fad_out_frame_count is set to 0. From a certain moment, when the decoder starts to process a speech signal of 8 kb/s or 12 kb/s, the narrowband-to-broadband switching flag fad_out_flag is set to 1. When the counter of transition frames fad_out_frame_count meets the condition fad_out_frame_count<N the coding parameter is weighted within the frequency-domain and the weighting factor changes over time.

If the rate of the speech frame occurring before the switch is higher than 14 kb/s, the coding parameters of the higher-band signal component received and buffered in the buffer may include a higher-band envelope within the MDCT domain and a frequency-domain envelope in the TDBWE algorithm. Otherwise, the higher-band signal coding parameters received and buffered in the buffer only include a frequency-domain envelope in the TDBWE algorithm. For the $k^{th}$ speech frame (k=1, . . . , N) occurring after the switch, the higher-band coding parameters in the buffer may be used to reconstruct the corresponding higher-band coding parameter of the current frame, the frequency-domain envelope or the higher-band envelope in the MDCT domain. These envelopes in the frequency-domain divide the entire higher-band into several sub-bands. These spectral envelopes are represented with $\hat{F}_{env}(j)$ (j=0, . . . , J−1, J is the number of the divided sub-bands, for example, J=12 for the frequency-domain envelope in the TDBWE algorithm according to G.729.1, and J=18 for the higher-band envelope in the MDCT domain). Each sub-band is weighted according to a time-varying fadeout gain factor gain(k,j), i.e., $\hat{F}_{env}(j)\cdot gain(k,j)$. Thus, the time-varying fadeout spectral envelope in the frequency-domain may be obtained. The equation for computing gain(k,j) is:

$$gain(k, j) = \frac{\max(0, (J-j)\times N - J\times k)}{J\times N},$$
$$k = 1, \ldots, N;$$
$$j = 0, \ldots, J-1$$

For the processed TDBWE frequency-domain envelope and the MDCT domain higher-band envelope, they may be decoded by using a TDBWE decoding algorithm and a TDAC decoding algorithm respectively. Thus, a time-varying fadeout higher-band signal component $\hat{s}_{HB}^{fad}(n)$ may be obtained.

In step S706, a QMF filter bank may perform a synthesis filtering on the fad processed higher-band signal component $\hat{s}_{HB}^{fad}(n)$ and the decoded lower-band signal component $\hat{s}_{LB}^{post}(n)$, to reconstruct a time-varying fadeout signal.

Figure 8:
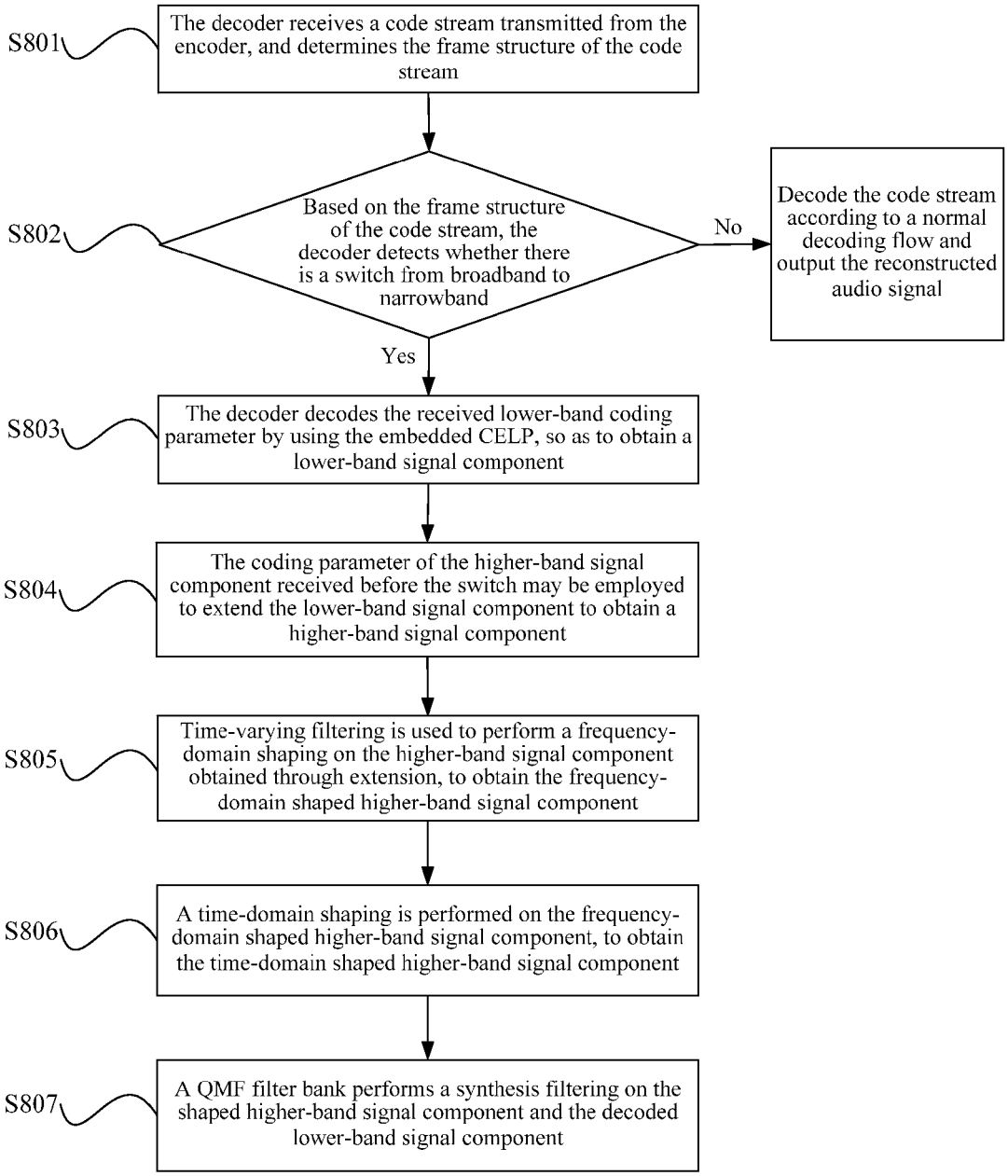
FIG. 8 is a flow chart of a method for decoding an audio signal in a fourth embodiment of the invention.

The audio signal may include a speech signal and a noise signal. In description of the second embodiment and the third embodiment of the invention, for example, the speech segment switches from broadband to narrowband. It will be appreciated that the noise segment may also switch from broadband to narrowband. In the fourth embodiment of the invention, for example, the code stream received by the decoder is a noise segment and the time-varying fadeout process uses the second method. In other words, a frequency-domain shaping is performed by using time-varying filtering on the higher-band information obtained through extension, and further a time-domain shaping may be performed on the frequency-domain shaped higher-band information by using a time-domain gain factor. A method for decoding an audio signal is shown in FIG. 8, including steps as follows.

In step S801, the decoder receives a code stream transmitted from the encoder, and determines the frame structure of the received code stream.

Specifically, the encoder encodes the audio signal according to the flow as shown in the systematic block diagram of FIG. 1, and transmits the code stream to the decoder. The decoder receives the code stream. If the audio signal corresponding to the code stream has no switch from broadband to narrowband, the decoder may decode the received code stream as normal according to the flow as shown in the systematic block diagram of FIG. 2. No repetition is made here. The code stream received by decoder is a speech segment. A speech frame in the speech segment may be a full rate speech frame or several layers of the full rate speech frame. The noise frame may be encoded and transmitted continuously, or may use the discontinuous transmission (DTX) technology. In this embodiment, the noise segment and the noise frame may have the same definition. In this embodiment, the noise frame received by the decoder is a full rate noise frame, and the encoding structure of the noise frame used in this embodiment is shown in Table 2.

TABLE 2

| Parameter description | Bit allocation | Layered structure |
|---|---|---|
| LSF parameter quantizer index | 1 | Narrowband core layer |
| Level 1 LSF quantized vector | 5 | |
| Level 2 LSF quantized vector | 4 | |
| Energy parameter quantized value | 5 | |
| Energy parameter level 2 quantized value | 3 | Narrowband enhancement layer |
| Level 3 LSF quantized vector | 6 | |
| Broadband component time-domain envelope | 6 | Broadband core layer |
| Broadband component frequency-domain envelope vector 1 | 5 | |
| Broadband component frequency-domain envelope vector 2 | 5 | |
| Broadband component frequency-domain envelope Vector 3 | 4 | |

In step S802, the decoder detects whether a switch from broadband to narrowband occurs according to the frame structure of the code stream. If such a switch occurs, the flow proceeds with step S803. Otherwise, the code stream is decoded according to the normal decoding flow and the reconstructed noise signal is output.

If a noise frame is received, the decoder may determine whether a switch from broadband to narrowband occurs according to the data length of the current frame. For example, if the data of the current frame only contains a narrowband core layer or a narrowband core layer plus a narrowband enhancement layer, that is, the length of the current frame is 15 bits or 24 bits, the current frame is narrowband. Otherwise, if the data of the current frame further contains a broadband core layer, that is, the length of the current frame is 43 bits, the current frame is broadband.

Based on the bandwidth of the noise signal determined from the current frame or the previous frame or frames, detection may be made as to whether a switch from broadband to narrowband is occurring currently.

If a Silence Insertion Descriptor (SID) frame received by the decoder contains a higher-band coding parameter (i.e., a broadband core layer), the higher-band coding parameter in the buffer is updated with the SID frame. Starting from a certain moment of the noise segment, when an SID frame received by the decoder no longer contains a broadband core layer, the decoder may determine that a switch from broadband to narrowband occurs.

In step S803, when the noise signal corresponding to the received code stream switches from broadband to narrowband, the decoder decodes the received lower-band coding parameter by using the embedded CELP, to obtain a lower-band signal component $\hat{s}_{LB}^{post}(n)$.

In step S804, by using the coding parameter of the higher-band signal component received before the switch, the lower-band signal component $\hat{s}_{LB}^{post}(n)$ is extended to obtain a higher-band signal component $\hat{s}_{HB}(n)$.

For a noise frame lacking any higher-band coding parameter, the synthesis parameter of the higher-band signal component may be estimated with a mirror interpolation method. If the noise frame is encoded and transmitted continuously, the higher-band coding parameters (the frequency-domain envelope and the higher-band spectral envelope) of the M recent noise frames (for example, M=5) buffered in the buffer are used as the mirror source to reconstruct the higher-band coding parameter of the $k^{th}$ noise frame after the switch from broadband to narrowband by using equation (1) in the second embodiment. If the noise frame uses the DTX technology, the two most recent SID frames containing a higher-band coding parameter (frequency-domain envelope) buffered in the buffer may be taken as the mirror source, to perform a segment linear interpolation starting from the current frame. Equation (3) is used to reconstruct the higher-band coding parameter of the $k^{th}$ noise frame after the switch from broadband to narrowband.

$$P_k = \frac{k}{N-1}P_{sid_past} + \left(1 - \frac{k}{N-1}\right)P_{sid_p_past} \tag{3}$$

The number of consecutive frames is N (for example, N=50). $P_{sid_past}$ represents the higher-band coding parameter of the most recent SID frame containing a broadband core layer stored in the buffer, and $P_{sid_p_past}$ represents the higher-band coding parameter of the next most recent SID frame containing a broadband core layer stored in the buffer. In the process, the buffered higher-band coding parameter of two noise frames before the switch may be used to estimate the higher-band coding parameter (frequency-domain envelope) of the N noise frames after the switch, so as to recover the higher-band signal component of the N noise frames after the switch. By using the TDBWE or TDAC decoding, the higher-band coding parameter reconstructed with equation (3) may be extended to obtain the higher-band signal component $\hat{s}_{HB}$ (n).

In step S805, time-varying filtering is used to perform a frequency-domain shaping on the higher-band signal component obtained through extension $\hat{s}_{HB}$ (n), to obtain a frequency-domain shaped higher-band signal component $\hat{s}_{HB}$ (n).

Specifically, when the frequency-domain shaping is being performed, the higher-band signal component obtained through extension $\hat{s}_{HB}$ (n) passes through a time-varying filter so that the frequency band of the higher-band signal component becomes narrower slowly over time. FIG. 6 shows the change in the pole point of the filter. Each time the decoder receives an SID frame containing a broadband core layer, the broadband-to-narrowband switching flag fad_out_flag is set to 0 and the counter of the filter points fad_out_flag is set to 0. Starting from a certain moment, when the decoder receives an SID frame containing no broadband core layer, the narrowband-to-broadband switching flag fad_out_flag is set to 1. And the time-varying filter is enabled to filter the reconstructed higher-band signal component. When the number of points of the filter fad_out_count meets the condition fad_out_count<FAD_OUT_COUNT_MAX, time-varying filtering is performed continuously. Otherwise, the time-varying filter process is stopped. Here FAD_OUT_COUNT_MAX=N×L is the number of transitions (for example, FAD_OUT_COUNT_MAX=8000).

It is assumed that the time-varying filter has a precise pole point of rel(i)+img(i)×j at moment i and the pole point moves to rel(m)+img(m)×j precisely at moment m. If the number of interpolations is N, the interpolation result at moment k is:

$$rel(k)=rel(i)\times(N-k)/N+rel(m)\times k/N$$

$$img(k)=img(i)\times(N-k)/N+img(m)\times k/N$$

The interpolation pole point may be used to recover filter coefficients at moment k, and a transfer function may be obtained:

$$H(z)=\frac{1+2z^{-1}+z^{-2}}{1-2rel(k)z^{-1}+[rel^2(k)+img^2(k)]z^{-2}}$$

When the decoder receives a broadband noise signal, the counter of the filter fad_out_count is set to 0. When the noise signal received by the decoder switches from broadband to narrowband, the time-varying filter is enabled and the filter counter may be updated as follows:

fad_out_count=min(fad_out_count+1, FAD_OUT_COUNT_MAX) where FAD_OUT_COUNT_MAX is the number of continuous samples during the transition phase.

Let $a_1$=2rel(k) and $a_2$[$rel^2$(k)+$img^2$(k)]. The higher-band signal component obtained through extension $\hat{s}_{HB}$(n) is the input signal of the time-varying filter, and $\hat{s}_{HB}^{fad}$(n) is the output signal of the time-varying filter.

$$\hat{s}_{HB}^{fad}(n)=\text{gain_filter}\times[a_1\times\hat{s}_{HB}^{fad}(n-1)+a_2\times\hat{s}_{HB}^{fad}(n-2)+\hat{s}_{HB}(n)+2.0\times\hat{s}_{HB}(n-1)+\hat{s}_{HB}(n-2)]$$

where gain_filter is the filter gain and its computing equation is:

$$\text{gain_filter}=\frac{1-a_1-a_2}{4}$$

In step S806, optionally, a time-domain shaping may be performed on the frequency-domain shaped higher-band signal component $\hat{s}_{HB}^{fad}$(n), to obtain a time-domain shaped higher-band signal component $\hat{s}_{HB}^{ts}$(n).

Specifically, when the time-domain shaping is being performed, a time-varying gain factor g(k) may be introduced. The changing curve of the time-varying factor is shown in FIG. 5. For the $k^{th}$ speech frame occurring after the switch, the higher-band signal component obtained through extension after the TDBWE or TDAC decoding is multiplied with a time-varying gain factor, as shown in equation (2). This implementation is similar to the process of performing time-domain shaping on the higher-band signal component in the second embodiment, and thus no repetition is made here. Alternatively, the time-varying gain factor in this step may be multiplied with the filter gain in the step S805. The two methods may obtain the same result.

In step S807, a QMF filter bank may be used to perform a synthesis filtering on the decoded lower-band signal component $\hat{s}_{LB}^{post}$(n) and the shaped higher-band signal component $\hat{s}_{HB}^{ts}$(n) (the higher-band signal component $\hat{s}_{HB}^{fad}$(n) if step S806 is not performed). Thus, a time-varying fadeout signal may be reconstructed, which meets the characteristics of a smooth transition from broadband to narrowband.

Figure 9:
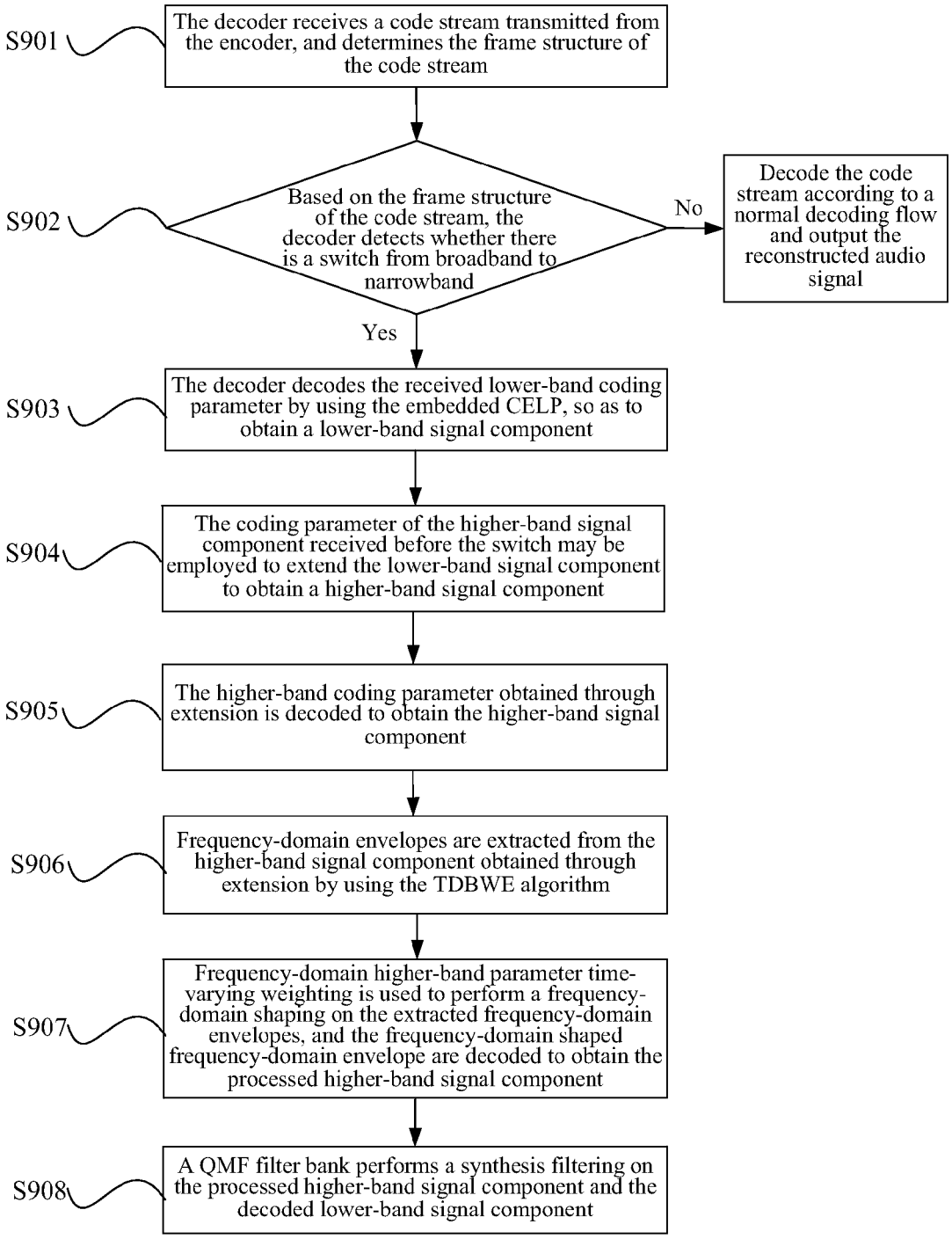
FIG. 9 is a flow chart of a method for decoding an audio signal in a fifth embodiment of the invention.

In this embodiment, for example, the time-varying fadeout process of the noise segment uses the second method, that is, a frequency-domain shaping is performed on the higher-band information obtained through extension by using time-varying filtering and further a time-domain shaping may be performed on the frequency-domain shaped higher-band information by using a time-domain gain factor. It may be understood that the time-varying fadeout process may use other alternative methods. In the fifth embodiment of the invention, for example, the code stream received by the decoder is a noise segment and the time-varying fadeout process uses the fourth method, that is, the higher-band information obtained through extension is divided into sub-bands, and a frequency-domain higher-band parameter time-varying weighting is performed on the coding parameter of each sub-band. An audio decoding method is shown in FIG. 9, including steps as follows.

Steps S901-S903 are similar to steps S801-S803 in the fourth embodiment, and thus no repetition is made here.

In step S904, the coding parameter of the higher-band signal component received before the switch (including but not limited to the frequency-domain envelope) may be used to obtain the higher-band coding parameter through extension.

For a noise frame lacking any higher-band coding parameter, the synthesis parameter of the higher-band signal component may be estimated with a mirror interpolation method. If the noise frame is encoded and transmitted continuously, the higher-band coding parameter (frequency-domain envelope and higher-band spectral envelope) of the M (for example, M=5) recent speech frames buffered in the buffer may be taken as the mirror source, to reconstruct the higher-band coding parameter of the $k^{th}$ frame after the switch from broadband to narrowband by using equation (1). If the noise frame uses the DTX technology, the two most recent SID frames containing a higher-band coding parameter (frequency-domain envelope) buffered in the buffer may be taken as the mirror source, to perform segment linear interpolation starting from the current frame. Equation (3) may be used to reconstruct the higher-band coding parameter of the $k^{th}$ frame after the switch from broadband to narrowband.

Since the higher-band coding parameters of the audio signal in different encoding algorithms may have different types, the above higher-band coding parameter obtained through extension might not be divided into sub-bands. In this case, the higher-band coding parameter obtained through extension may be decoded to obtain a higher-band signal component, and a higher-band coding parameter may be extracted from the higher-band signal component obtained through extension, for performing frequency-domain shaping.

In step S905, the higher-band coding parameter obtained through extension is decoded to obtain a higher-band signal component.

In step S906, frequency-domain envelopes may be extracted from the higher-band signal component obtained through extension by using a TDBWE algorithm. These frequency-domain envelopes may divide the entire higher-band signal component into a series of non-overlapping sub-bands.

In step S907, frequency-domain higher-band parameter time-varying weighting is used to perform a frequency-domain shaping on the extracted frequency-domain envelope. The frequency-domain shaped frequency-domain envelope is decoded to obtain a processed higher-band signal component.

Specifically, a time-varying weighting process is performed on the extracted frequency-domain envelope. The frequency-domain envelopes are equivalent to dividing the higher-band signal component into several sub-bands in the frequency-domain, and thus frequency-domain weighting is performed on each frequency-domain envelope with a different gain so that the signal band becomes narrower slowly. When the decoder successively receives SID frames containing the higher-band coding parameter, it may be considered to be in the broadband noise signal phase. The broadband-to-narrowband switching flag fad_out_flag is set to 0, and the counter of the transition frames fad_out_frame_count is set to 0. When an SID frame received by the decoder starting from a certain moment does not contain a broadband core layer, the decoder determines that a switch from broadband to narrowband occurs. The broadband-to-narrowband switching flag fad_out_flag is set to 1. When the counter of the transition frames fad_out_frame_count meets the condition fad_out_frame_count<N, a time-varying fadeout process is performed by weighting the coding parameter in the frequency-domain, and the weighting factor changes over time, where N is the number of transition frames (for example, N=50).

The higher-band coding parameter of the $k^{th}$ frame (k=0, . . . , N−1) after the switch from broadband to narrowband may be reconstructed with equation (3), and the reconstructed higher-band coding parameter may be decoded to obtain the higher-band signal component. The frequency-domain envelopes $\hat{F}_{env}(j)$ (j=0, . . . , J−1, J is the number of the divided sub-bands) may be extracted from the higher-band signal component obtained through extension by using the TDBWE algorithm. The frequency-domain envelope of each sub-band is weighted by using a time-varying fadeout gain factor gain(k,j), that is, $\hat{F}_{env}(j)\cdot gain(k,j)$. Thus, the time-varying fadeout spectral envelope may be obtained in the frequency-domain. The equation for computing gain(k,j) is:

$$\text{gain}(k, j) = \frac{\max(0, (J-j)\times N - J\times k)}{J\times N},$$

$$k = 1, \ldots, N;$$

$$j = 0, \ldots, J-1$$

The time-varying fadeout TDBWE frequency-domain envelope may be decoded with the TDBWE decoding algorithm to obtain a processed time-varying fadeout higher-band signal component.

In step S908, a QMF filter bank may perform a synthesis filtering on the processed higher-band signal component and the decoded lower-band signal component $\hat{s}_{LB}^{post}(n)$, to reconstruct the time-varying fadeout signal.

In description of the above embodiments of the invention, for example, the speech segment or noise segment corresponding to the code stream received by the decoder switches from broadband to narrowband. It may be understood that there may be two cases as follows. The speech segment corresponding to the code stream received by the decoder switches from broadband to narrowband, and after the switch, the decoder can still receive the noise segment corresponding to the code stream. Or, the noise segment corresponding to the code stream received by the decoder switches from broadband to narrowband, and after the switch, the decoder can still receive the speech segment corresponding to the code stream.

Figure 10:
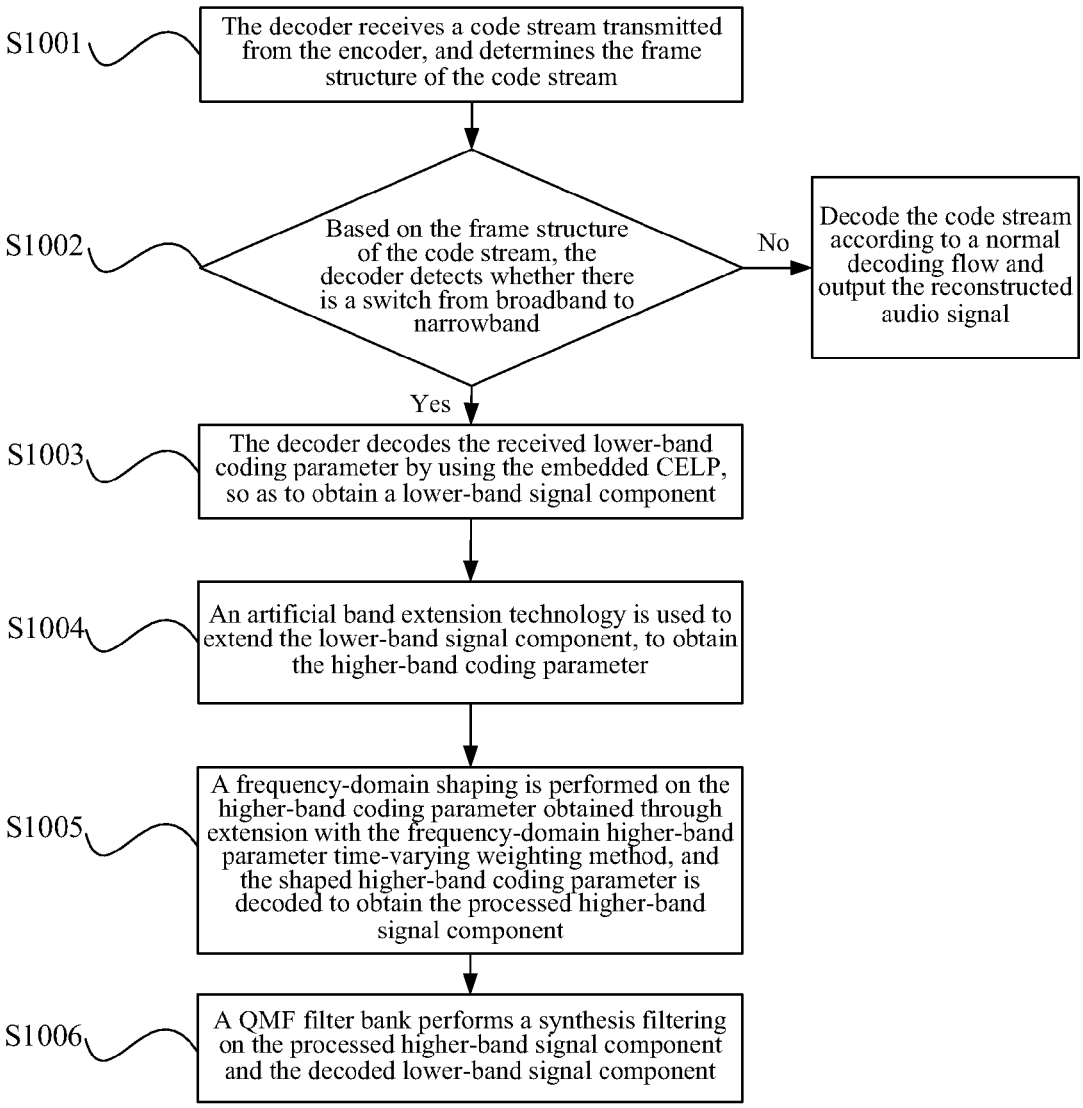
FIG. 10 is a flow chart of a method for decoding an audio signal in a sixth embodiment of the invention.

In the sixth embodiment of the invention, for example, the speech segment corresponding to the code stream received by the decoder switches from broadband to narrowband, the decoder can still receive the noise segment corresponding to the code stream after the switch, and the time-varying fadeout process uses the third method. In other words, a frequency-domain shaping is performed on the higher-band information obtained through extension by using a frequency-domain higher-band parameter time-varying weighting method. An audio decoding method is shown in FIG. 10, including steps as follows.

In step S1001, the decoder receives a code stream transmitted from the encoder, and determines the frame structure of the received code stream.

Specifically, the encoder encodes the audio signal according to the flow as shown in the systematic block diagram of FIG. 1, and transmits the code stream to the decoder. The decoder receives the code stream. If the audio signal corresponding to the code stream has no switch from broadband to narrowband, the decoder may decode the received code stream as normal according to the flow as shown in the systematic block diagram of FIG. 2. No repetition is made here. In this embodiment, the code stream received by the decoder includes a speech segment and a noise segment. The speech frames in the speech segment have the frame structure of a full rate speech frame as shown in Table 1, and the noise frames in the noise segment have the frame structure of a full rate noise frame shown in Table 2.

In step S1002, the decoder detects whether a switch from broadband to narrowband occurs according to the frame structure of the code stream. If such a switch occurs, the flow proceeds with step S1003. Otherwise, the code stream is decoded according to the normal decoding flow and the reconstructed audio signal is output.

In step S1003, when the speech signal corresponding to the received code stream switches from broadband to narrowband, the decoder decodes the received lower-band coding parameter by using the embedded CELP, to obtain a lower-band signal component $\hat{s}_{LB}^{post}(n)$.

In step S1004, an artificial band extension technology may be used to extend the lower-band signal component $\hat{s}_{LB}^{post}(n)$, to obtain a higher-band coding parameter.

When a switch from broadband to narrowband occurs, the audio signal stored in the buffer may be of a type same as or different from the audio signal received after the switch. There may be five cases as follows.

(1) Only higher-band coding parameters of the noise frame are stored in the buffer (in other words, only TDBWE frequency-domain envelopes, without TDAC higher-band envelopes), and the frames received after the switch are all speech frames.

(2) Only higher-band coding parameters of the noise frame are stored in the buffer (in other words, only TDBWE frequency-domain envelopes, without TDAC higher-band envelopes), and the frames received after the switch are all noise frames.

(3) Higher-band coding parameters of the speech frame are stored in the buffer (in other words, both TDBWE frequency-domain envelopes and TDAC higher-band envelopes), and the frames received after the switch are all speech frames.

(4) Higher-band coding parameters of the speech frame are stored in the buffer (in other words, both TDBWE frequency-domain envelopes and TDAC higher-band envelopes), and the frames received after the switch are all noise frames.

(5) Higher-band coding parameters of the speech frame are stored in the buffer (in other words, both TDBWE frequency-domain envelopes and TDAC higher-band envelopes), and higher-band coding parameters of the noise frame are stored in the buffer (in other words, only TDBWE frequency-domain envelopes, without TDAC higher-band envelopes). The frames received after the switch may include both noise frames and speech frames.

Detailed descriptions have been made to case (2) and case (3) in the above embodiments. In the three remaining cases, after the switch, the higher-band coding parameter may be reconstructed in accordance with the method of equation (1). However, the higher-band coding parameter of the noise frame has no TDAC higher-band envelope. Therefore, in the case where a noise segment is received after the speech segment has a switch, the higher-band coding parameter is no longer reconstructed. In other words, the TDAC higher-band envelope will not be reconstructed because the TDAC encoding algorithm is only an enhancement to the TDBWE encoding. With the TDBWE frequency-domain envelope, it is sufficient to recover the higher-band signal component. In other words, when the solution of this embodiment is enabled (i.e., within N frames after the switch), the speech frames are decoded at a decreased rate of 14 kb/s until the entire time-varying fadeout operation is completed. For the $k^{th}$ frame (k=1, . . . , N) after the switch, the frequency-domain envelopes of the higher-band coding parameter may be reconstructed, $\hat{F}_{em}(j)$ (j=0, . . . , J−1, J=12).

In step S1005, a frequency-domain shaping is performed on the higher-band coding parameter obtained through extension with the frequency-domain higher-band parameter time-varying weighting method, and the shaped higher-band coding parameter is decoded to obtain a processed higher-band signal component.

Specifically, during the frequency-domain shaping, the higher-band signal is divided into several sub-bands within the frequency-domain, and then frequency-domain weighting is performed on each sub-band or the higher-band coding parameter characterizing each sub-band with a different gain so that the signal band becomes narrower slowly. The frequency-domain envelope in the TDBWE encoding algorithm used in the speech frame or the frequency-domain envelope in the broadband core layer of the noise frame may imply a process of dividing a higher-band into a number of sub-bands. The decoder receives an audio signal containing a higher-band coding parameter (including an SID frame having a broadband core layer and a speech frame having a rate of 14 kb/s or higher). The broadband-to-narrowband switching flag fad_out_flag is set to 0, and the number of transition frames fad_out_frame_count is set to 0. From a certain moment, when the audio signal received by the decoder contains no higher-band coding parameter (there is no broadband core layer in the SID frame or the speech frame is lower than 14 kb/s), the decoder may determine a switch from broadband to narrowband. The broadband-to-narrowband switching flag fad_out_flag is set to 1. When the number of transition frames fad_out_frame_count meets the condition fad_out_frame_count<N, a time-varying fadeout process is performed by weighting the coding parameter in the frequency-domain, and the weighting factor changes over time where N is the number of transition frames (for example, N=50).

J frequency-domain envelopes may divide the higher-band signal component into J sub-bands. Each frequency-domain envelope is weighted with a time-varying gain factor gain(k,j) in other words, $\hat{F}_{em}(j)\cdot grain(k,j)$. Thus, the time-varying fadeout spectral envelope may be obtained within the frequency-domain. The equation for computing gain(k,j) is:

$$\text{gain}(k, j) = \frac{\max(0, (J-j)\times N - J\times k)}{J\times N},$$
$$k = 1, \ldots, N;$$
$$j = 0, \ldots, J-1$$

The processed TDBWE frequency-domain envelope may be decoded with the TDBWE decoding algorithm, to obtain a processed time-varying fadeout higher-band signal component.

In step S1006, a QMF filter bank may perform a synthesis filtering on the processed higher-band signal component and the decoded lower-band signal component $\hat{s}_{LB}^{post}(n)$, to reconstruct the time-varying fadeout signal.

Figure 11:
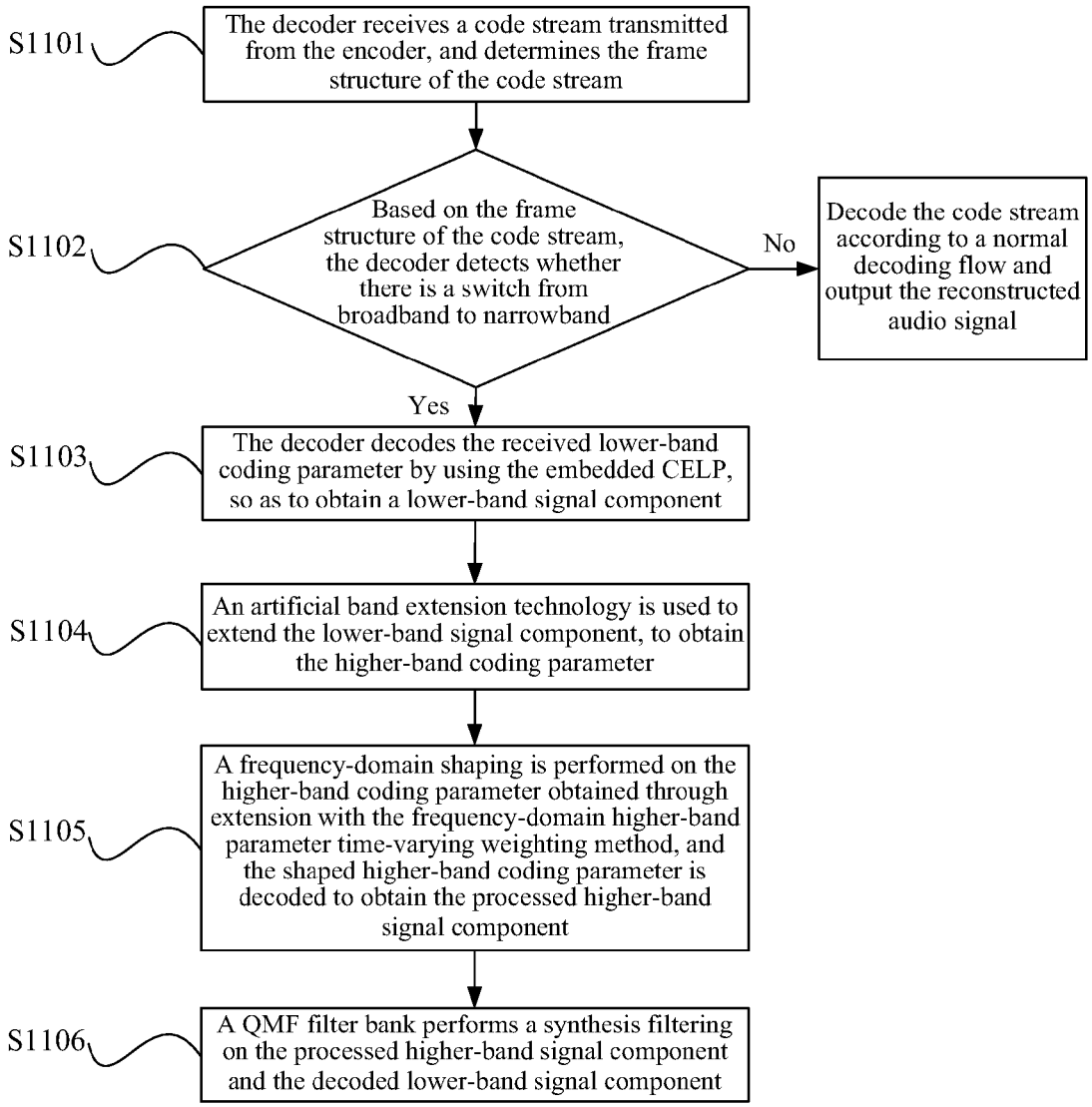
FIG. 11 is a flow chart of a method for decoding an audio signal in a seventh embodiment of the invention.

In the seventh embodiment of the invention, for example, the noise segment corresponding to the code stream received by the decoder switches from broadband to narrowband. After the switch, the decoder can still receive a speech segment corresponding to the code stream, and the time-varying fadeout process employs the third method. In other words, a frequency-domain higher-band parameter time-varying weighting method may be used to perform a frequency-domain shaping on the higher-band information obtained through extension. An audio decoding method is shown in FIG. 11, including steps as follows.

Steps S1101-S1102 are similar to steps S1001-S1002 in the sixth embodiment, and thus no repetition is made here.

In step S1103, when the noise signal corresponding to the received code stream switches from broadband to narrowband, the decoder decodes the received lower-band coding parameter by using the embedded CELP, to obtain a lower-band signal component $\hat{s}_{LB}^{post}(n)$.

In step S1104, an artificial band extension technology may be used to extend the lower-band signal component $\hat{s}_{LB}^{post}(n)$, so as to obtain a higher-band coding parameter.

In step S1105, a frequency-domain higher-band parameter time-varying weighting method may be used to perform a frequency-domain shaping on the higher-band coding parameter obtained through extension, and the shaped higher-band coding parameter is decoded to obtain a processed higher-band signal component.

Specifically, during the frequency-domain shaping, a frequency-domain weighting is performed on the higher-band coding parameter representing each sub-band with a different gain so that the signal band becomes wider slowly. The decoder receives an audio signal containing a broadband coding parameter (including an SID frame having a broadband core layer and a speech frame having a rate of 14 kb/s or higher). The broadband-to-narrowband switching flag fad_out_flag is set to 0, and the transition frame counter fad_out_frame_count is set to 0. Starting from a certain moment, when the audio signal received by the decoder contains no broadband coding parameter (in other words, the SID frame has no broadband core layer or the speech frame has a rate of lower than 14 kb/s), the decoder determines the occurrence of a switch from broadband to narrowband. Then, the broadband-to-narrowband switching flag fad_out_flag is set to 1. When the counter of transition frames fad_out_frame_count meets the condition fad_out_frame_count<N, a time-varying fadeout process is performed by weighting the coding parameter in the frequency-domain, and the weighting factor changes over time, where N is the number of transition frames (for example, N=50).

In this embodiment, when a switch occurs, only broadband coding parameters of the noise frame are stored in the buffer (i.e., only TDBWE frequency-domain envelopes, without TDAC higher-band envelopes). The frames received after the switch will contain both noise frames and speech frames. After the switch occurs, the higher-band coding parameter in the duration of the solution of the embodiment may be reconstructed with the method of equation (1). However, the higher-band coding parameter of the noise has no TDAC higher-band envelope parameter as needed in the speech frame. Therefore, when the higher-band coding parameter is reconstructed for the received speech frame, the TDAC higher-band envelope is no longer reconstructed because the TDAC encoding algorithm is only an enhancement to the TDBWE encoding. With the TDBWE frequency-domain envelope, it is sufficient to recover the higher-band signal component. In other words, when the solution of this embodiment is enabled (i.e., within N frames after the switch), the speech frames are decoded at a decreased rate of 14 kb/s until the entire time-varying fadeout operation is completed. For the $k^{th}$ frame (k=1, . . . , N) after the switch, the reconstructed high broadband coding parameter is that the frequency-domain envelopes $\hat{F}_{env}(j)$ (j=0, . . . , J−1, J=12) divide the higher-band component into J sub-bands. Each sub-band is weighted with a time-varying fadeout gain factor gain(k,j) in other words, $\hat{F}_{env}(j)\cdot gain(k,j)$. Thus, the time-varying fadeout spectral envelope may be obtained in the frequency-domain. The equation for computing gain(k,j) is:

$$gain(k, j) = \frac{\max(0, (J-j)\times N - J\times k)}{J\times N},$$
$$k = 1, \ldots, N;$$
$$j = 0, \ldots, J-1$$

The processed TDBWE frequency-domain envelope may be decoded with the TDBWE decoding algorithm, so as to obtain a time-varying fadeout higher-band signal component.

In step S1106, a QMF filter bank may perform a synthesis filtering on the processed higher-band signal component and the decoded narrowband signal component $\hat{s}_{LB}^{post}(n)$, so as to reconstruct a time-varying fadeout signal.

Figure 12:
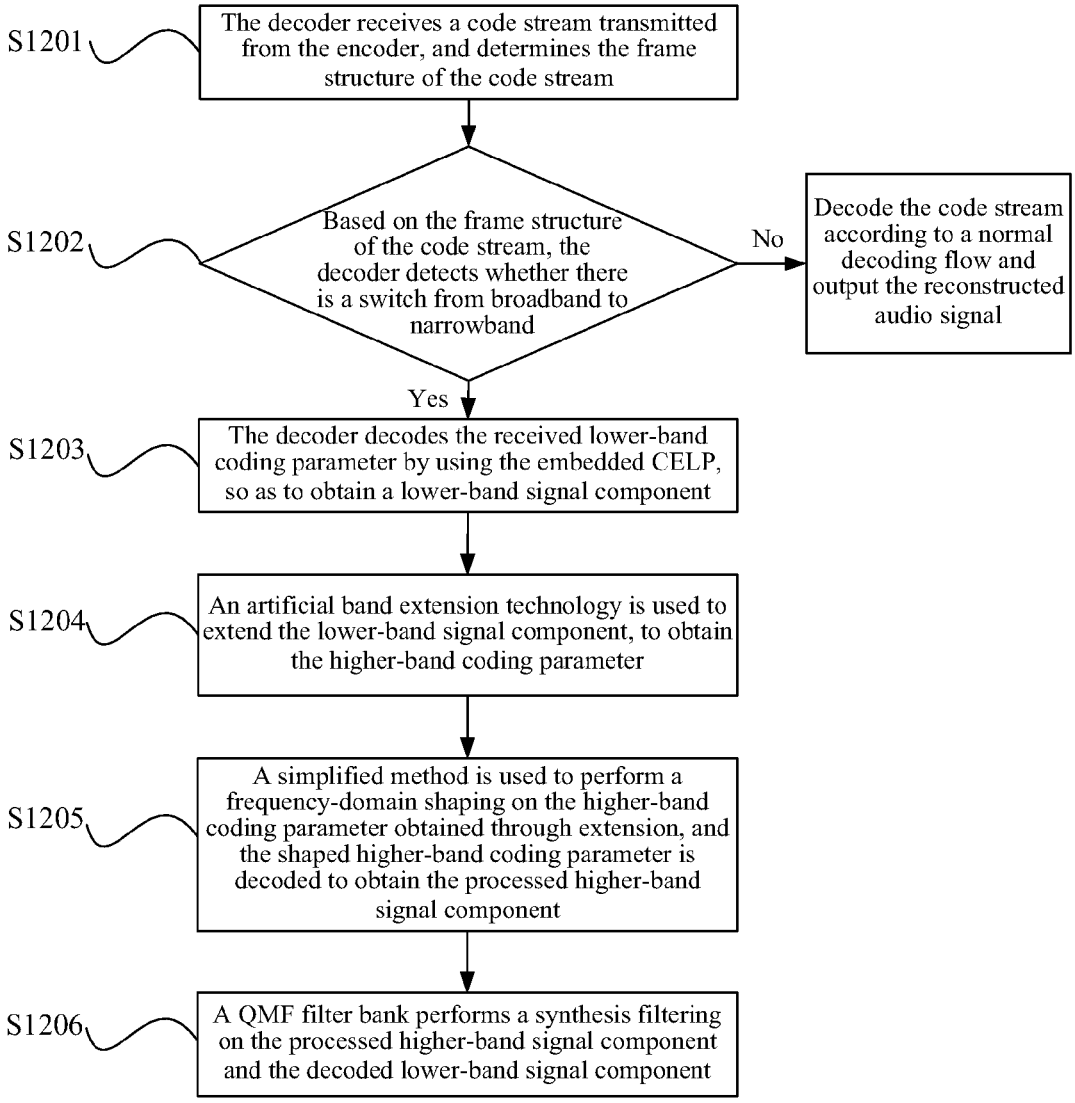
FIG. 12 is a flow chart of a method for decoding an audio signal in an eighth embodiment of the invention.
Figure 13:
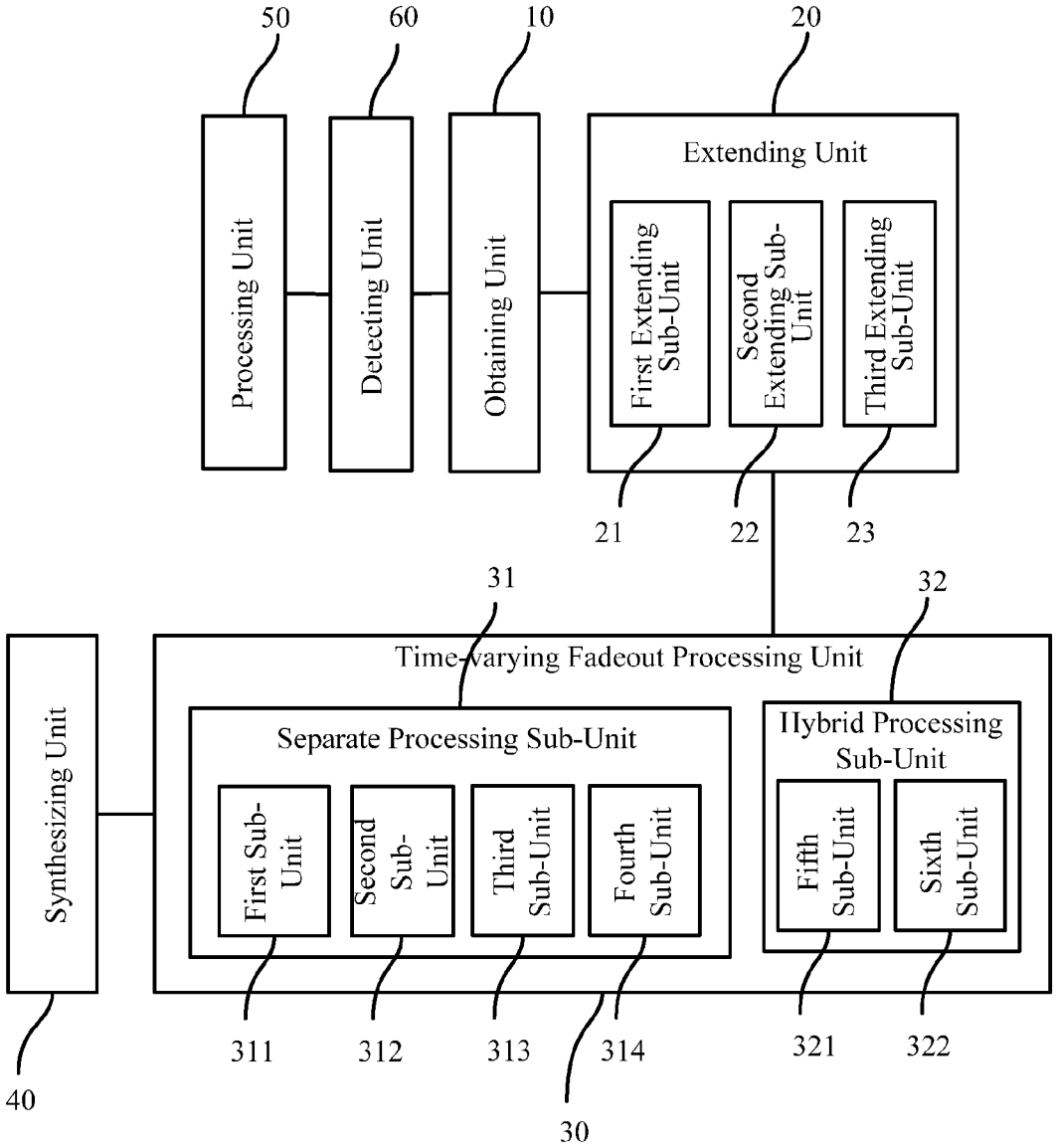
FIG. 13 schematically shows an apparatus for decoding an audio signal in a ninth embodiment of the invention.

In the eighth embodiment of the invention, for example, the speech segment corresponding to the code stream received by the decoder switches from broadband to narrowband, the decoder still may receive a noise segment corresponding to the code stream after the switch, and the time-varying fadeout process uses a simplified version of the third method. An audio decoding method is shown in FIG. 12, including steps as follows.

Steps S1201-S1202 are similar to steps S1001-S1002 in the sixth embodiment, and thus no repetition is made here.

In step S1203, when the received speech signal switches from broadband to narrowband, the decoder may decode the received lower-band coding parameter with the embedded CELP, to obtain a lower-band signal component $\hat{s}_{LB}^{post}(n)$.

In step S1204, an artificial band extension technology is used to extend the lower-band signal component $\hat{s}_{LB}^{post}(n)$ to obtain the higher-band coding parameter.

In the occurrence of a switch from broadband to narrowband, the audio signal stored in the buffer may be of a type same as or different from the audio signal received after the switch, and the five cases as described in the sixth embodiment may be included. Detailed descriptions have been made to case (2) and case (3) in the above embodiments. For the three remaining cases, after the switch, the higher-band coding parameter may be reconstructed in accordance with the method of equation (1). However, the higher-band coding parameter of the noise frame has no TDAC higher-band envelope. Therefore, to reconstruct the coding parameter, the TDAC higher-band envelope will not be reconstructed, and only the frequency-domain envelope $\hat{F}_{env}(j)$ in the TDBWE algorithm is reconstructed. The TDAC encoding algorithm is only an enhancement to the TDBWE encoding. With the TDBWE frequency-domain envelope, it is sufficient to recover the higher-band signal component. In other words, when the solution of this embodiment is enabled (i.e., within $COUNT_{fad_out}$ frames after the switch), the speech frames are decoded at a decreased rate of 14 kb/s until the entire time-varying fadeout operation is completed. For the $k^{th}$ frame (k=0, . . . , $COUNT_{fad_out}$−1) after the switch, the reconstructed higher-band coding parameter is such that the frequency-domain envelope $\hat{F}_{env}(j)$ (j=0, . . . , J−1) divides the higher-band signal component into J sub-bands.

In step S1205, a simplified method is used to perform a frequency-domain shaping on the higher-band coding parameter obtained through extension, and the shaped higher-band coding parameter is decoded to obtain a processed higher-band signal component.

During the frequency-domain shaping, the reconstructed frequency-domain envelope $\hat{F}_{env}(j)$ divides the higher-band signal into J sub-bands within the frequency-domain. When the broadband-to-narrowband switching flag fad_out_flag is 1 and the transition frame counter fad_out_frame_count meets the condition fad_out_frame_count<$COUNT_{fad_out}$, a time-varying fadeout process is performed on the frequency-domain envelope reconstructed for the $k^{th}$ frame after the switch with equation (4) or (5) or (6).

$$\hat{F}_{env}(j) = \begin{cases} \hat{F}_{env}(j) & j \le \left\lfloor \frac{k\cdot J}{COUNT_{fad_out}} \right\rfloor \\ 0 & j > \left\lfloor \frac{k\cdot J}{COUNT_{fad_out}} \right\rfloor \end{cases} \quad (4)$$

$$\hat{F}_{env}(j) = \begin{cases} \hat{F}_{env}(j) & j \le \left\lfloor \frac{(COUNT_{fad_out}-k)\cdot J}{COUNT_{fad_out}} \right\rfloor \\ 0 & j > \left\lfloor \frac{(COUNT_{fad_out}-k)\cdot J}{COUNT_{fad_out}} \right\rfloor \end{cases} \quad (5)$$

-continued $$\hat{F}_{env}(j) = \begin{cases} \hat{F}_{env}(j) & j \le \left\lfloor \frac{(COUNT_{fad_out} - k) \cdot J}{COUNT_{fad_out}} \right\rfloor \\ \text{LOW_LEVEL} & j > \left\lfloor \frac{(COUNT_{fad_out} - k) \cdot J}{COUNT_{fad_out}} \right\rfloor \end{cases} \quad (6)$$

where $\lfloor x \rfloor$ represents the largest integer no more than x. The TDBWE decoding algorithm may be used for the processed TDBWE frequency-domain envelope, to obtain a time-varying fadeout higher-band signal component. LOW_LEVEL is the smallest possible value for the frequency-domain envelope in the quantization table. For example, the frequency-domain envelope $\hat{F}_{env}(j)$ (j=0, . . . , 3) uses a multi-level quantization technology, and level 1 quantization codebook is:

| Index | Level 1 vector quantization codebook | | | |
|---|---|---|---|---|
| 000 | −3.0000000000f | −2.0000000000f | −1.0000000000f | −0.5000000000f |
| 001 | 0.0000000000f | 0.5000000000f | 1.0000000000f | 1.5000000000f |
| 010 | 2.0000000000f | 2.5000000000f | 3.0000000000f | 3.5000000000f |
| 011 | 4.0000000000f | 4.5000000000f | 5.0000000000f | 5.5000000000f |
| 100 | 0.2500000000f | 0.7500000000f | 1.2500000000f | 1.7500000000f |
| 101 | 2.2500000000f | 2.7500000000f | 3.2500000000f | 3.7500000000f |
| 110 | 4.2500000000f | 4.7500000000f | 5.2500000000f | 5.7500000000f |
| 111 | −1.5000000000f | 9.5000000000f | 10.5000000000f | −2.5000000000f |

Level 2 quantization codebook is:

| Index | Level 2 vector quantization codebook | | | |
|---|---|---|---|---|
| 0000 | −2.9897100000f | −2.9897100000f | −1.9931400000f | −0.9965700000f |
| 0001 | 1.9931400000f | 1.9931400000f | 1.9931400000f | 1.9931400000f |
| 0010 | 0.0000000000f | 0.0000000000f | −1.9931400000f | −1.9931400000f |
| 0011 | −0.9965700000f | −0.9965700000f | −0.9965700000f | −1.9931400000f |
| 0100 | 0.9965700000f | 0.9965700000f | 0.0000000000f | −0.9965700000f |
| 0101 | 0.9965700000f | 0.9965700000f | 0.9965700000f | 0.0000000000f |
| 0110 | −1.9931400000f | −1.9931400000f | −2.9897100000f | −2.9897100000f |
| 0111 | 0.0000000000f | 0.9965700000f | 0.0000000000f | −0.9965700000f |
| 1000 | −12.9554100000f | −12.9554100000 | −12.9554100000f | −12.9554100000f |
| 1001 | 0.0000000000f | 0.9965700000f | 0.9965700000f | 0.9965700000f |
| 1010 | 0.0000000000f | −0.9965700000f | −0.9965700000f | −0.9965700000f |
| 1011 | −1.9931400000f | −0.9965700000f | 0.0000000000f | 0.0000000000f |
| 1100 | −0.9965700000f | 0.0000000000f | 0.0000000000f | 0.9965700000f |
| 1101 | −5.9794200000f | −8.9691300000f | −8.9691300000f | −4.9828500000f |
| 1110 | 0.9965700000f | 0.0000000000f | 0.0000000000f | 0.0000000000f |
| 1111 | −3.9862800000f | −3.9862800000f | −4.9828500000f | −4.9828500000f |

Then, $\hat{F}_{env}(j)=l1(j)+l2(j)$, where l1(j) is a level 1 quantized vector, l2(j) is a level 2 quantized vector. In this embodiment, the minimum value of $\hat{F}_{env}(j)$ is −3.0000+(−12.95541)=−15.95541. Further, in practical deployments, the minimum value may be simplified to selection of a value small enough.

Further, it is to be noted that the above method for determining $\hat{F}_{env}(j)$ is a preferred embodiment of the invention. In practical deployments, the value may be simplified or substituted with other values meeting the technical requirements according to specific technical demands. These changes also fall within the scope of the invention.

In step S1206, a QMF filter bank performs a synthesis filtering on the processed higher-band signal component and the decoded reconstructed lower-band signal component, to reconstruct a time-varying fadeout signal.

The invention applies to a switch from broadband to narrowband, as well as a switch from UWB to broadband. In the above described embodiments, the higher-band signal component is decoded with the TDBWE or TDAC decoding algorithm. It is to be noted that the invention also applies to other broadband encoding algorithms in addition to the TDBWE and TDAC decoding algorithm. Additionally, there may be different methods for extending the higher-band signal component and the higher-band coding parameter after the switch, and no description is made here.

With the methods provided in the embodiments of the invention, when an audio signal has a switch from broadband to narrowband, a series of processes such as bandwidth detection, artificial band extension, time-varying fadeout process, and bandwidth synthesis, may be used to make the switch to have a smooth transition from a broadband signal to a narrowband signal so that a comfortable listening experience may be achieved.

In the ninth embodiment of the invention, an audio decoding apparatus is shown in FIG. 12, including an obtaining unit 10, an extending unit 20, a time-varying fadeout processing unit 30, and a synthesizing unit 40.

The obtaining unit 10 is configured to obtain a lower-band signal component of an audio signal corresponding to a received code stream when the audio signal switches from a first bandwidth to a second bandwidth which is narrower than the first bandwidth, and transmit the lower-band signal component to the extending unit 20.

The extending unit 20 is configured to extend the lower-band signal component to obtain higher-band information, and transmit the higher-band information obtained through extension to the time-varying fadeout processing unit 30.

The time-varying fadeout processing unit 30 is configured to perform a time-varying fadeout process on the higher-band information obtained through extension to obtain a processed higher-band signal component, and transmit the processed higher-band signal component to the synthesizing unit 40.

The synthesizing unit 40 is configured to synthesize the received processed higher-band signal component and the lower-band signal component obtained by the obtaining unit 10.

The apparatus further includes a processing unit 50 and a detecting unit 60.

The processing unit 50 is configured to determine the frame structure of the received code stream, and transmit the frame structure of the code stream to the detecting unit 60.

The detecting unit 60 is configured to detect whether a switch from the first bandwidth to the second bandwidth occurs according to the frame structure of the code stream transmitted from the processing unit 50, and transmit the code stream to the obtaining unit 10 if the switch from the first bandwidth to the second bandwidth occurs.

Specifically, the extending unit 20 further includes at least one of a first extending sub-unit 21, a second extending sub-unit 22, and a third extending sub-unit 23.

The first extending sub-unit 21 is configured to extend the lower-band signal component by using a coding parameter for the higher-band signal component received before the switch so as to obtain a higher-band coding parameter.

The second extending sub-unit 22 is configured to extend the lower-band signal component by using a coding parameter for the higher-band signal component received before the switch so as to obtain a higher-band signal component.

The third extending sub-unit 23 is configured to extend the lower-band signal component decoded from the current audio frame after the switch, so as to obtain the higher-band signal component.

The time-varying fadeout processing unit 30 further includes at least one of a separate processing sub-unit 31 and a hybrid processing sub-unit 32.

The separate processing sub-unit 31 is configured to perform a time-domain shaping and/or frequency-domain shaping on the higher-band signal component obtained through extension when the higher-band information obtained through extension is a higher-band signal component, and transmit the processed higher-band signal component to the synthesizing unit 40.

The hybrid processing sub-unit 32 is configured to: when the higher-band information obtained through extension is a higher-band coding parameter, perform a frequency-domain shaping on the higher-band coding parameter obtained through extension; or when the higher-band information obtained through extension is a higher-band signal component, divide the higher-band signal component obtained through extension into sub-bands, perform a frequency-domain shaping on the coding parameter for each sub-band, and transmit the processed higher-band signal component to the synthesizing unit 50.

The separate processing sub-unit 31 further includes at least one of a first sub-unit 311, a second sub-unit 312, a third sub-unit 313, and a fourth sub-unit 314.

The first sub-unit 311 is configured to perform a time-domain shaping on the higher-band signal component obtained through extension by using a time-domain gain factor, and transmit the processed higher-band signal component to the synthesizing unit 40.

The second sub-unit 312 is configured to perform a frequency-domain shaping on the higher-band signal component obtained through extension by using time-varying filtering, and transmit the processed higher-band signal component to the synthesizing unit 40.

The third sub-unit 313 is configured to perform a time-domain shaping on the higher-band signal component obtained through extension by using a time-domain gain factor, perform a frequency-domain shaping on the time-domain shaped higher-band signal component by using time-varying filtering, and transmit the processed higher-band signal component to the synthesizing unit 40.

The fourth sub-unit 314 is configured to perform a frequency-domain shaping on the higher-band signal component obtained through extension by using time-varying filtering, perform a time-domain shaping on the frequency-domain shaped higher-band signal component by using a time-domain gain factor, and transmit the processed higher-band signal component to the synthesizing unit 40.

The hybrid processing sub-unit 32 further includes at least one of a fifth sub-unit 321 and a sixth sub-unit 322.

The fifth sub-unit 321 is configured to: when the higher-band information obtained through extension is a higher-band coding parameter, perform a frequency-domain shaping on the higher-band coding parameter obtained through extension by using a frequency-domain higher-band parameter time-varying weighting method, so as to obtain a time-varying fadeout spectral envelope, obtain a higher-band signal component through decoding, and transmit the processed higher-band signal component to the synthesizing unit 40.

The sixth sub-unit 322 is configured to: when the higher-band information obtained through extension is a higher-band signal component, divide the higher-band signal component obtained through extension into sub-bands; perform a frequency-domain higher-band parameter time-varying weighting on the coding parameter for each sub-band to obtain a time-varying fadeout spectral envelope; obtain a higher-band signal component through decoding; and transmit the processed higher-band signal component to the synthesizing unit 40.

With the apparatus provided in the embodiments of the invention, when an audio signal has a switch from broadband to narrowband, a series of processes such as bandwidth detection, artificial band extension, time-varying fadeout process, and bandwidth synthesis, may be used to make the switch to have a smooth transition from a broadband signal to a narrowband signal so that a comfortable listening experience may be achieved.

From the above description to the various embodiments, those skilled in the art may clearly appreciate that the present invention may be implemented in hardware or by means of software and a necessary general-purpose hardware platform. Based on this understanding, the technical solution of the present invention may be embodied in a software product. The software product may be stored in a non-volatile storage media (which may be ROM/RAM, U disk, removable disk, etc.), including several instructions which cause a computer device (a PC, a server, a network device, or the like) to perform the methods according to the various embodiments of the present invention.

Detailed descriptions have been made above to the invention with reference to some preferred embodiments, which are not used to limit the scope of the present invention. Various changes, equivalent substitutions, and improvements made within the spirit and principle of the invention are intended to fall within the scope of the invention.

What is claimed is:

1. A method for decoding an audio signal, comprising:

obtaining a lower-band signal component of an audio signal in a received code stream when the audio signal switches from a first bandwidth to a second bandwidth which is narrower than the first bandwidth;

extending the lower-band signal component to obtain higher-band information; performing a time-varying fadeout process on the higher-band information obtained through extension to obtain a processed higher-band signal component; and synthesizing the processed higher-band signal component and the obtained lower-band signal component;

wherein performing a time-varying fadeout process on the higher-band information further comprises:

performing a separate time-varying fadeout process on the higher-band information;

or performing a hybrid time-varying fadeout process on the higher-band information;

wherein the higher-band information is a higher-band signal component and the step of performing a separate time-varying fadeout process on the higher-band information further comprises:

performing a time-domain shaping on the higher-band signal component obtained through extension by using a time-domain gain factor;

or performing a frequency-domain higher-band signal component obtained through extension by using time-varying filtering; and wherein after performing a time-domain shaping on the higher-band signal component obtained through extension by using a time-domain gain factor, the method further comprises:

performing a frequency-domain time-domain shaped higher-band signal component by using time-varying filtering.

2. The audio signal decoding method according to claim 1, wherein after performing a frequency-domain shaping on the higher-band signal component obtained through extension by using time-varying filtering, the method further comprises:

performing a time-domain shaping on the frequency-domain shaped higher-band signal component by using a time-domain gain factor.

3. The audio signal decoding method according to claim 1, wherein performing a hybrid time-varying fadeout process on the higher-band information further comprises:

when the higher-band information is a higher-band coding parameter, performing a frequency-domain shaping on the higher-band coding parameter obtained through extension by using a frequency-domain higher-band parameter time-varying weighting method, to obtain a time-varying fadeout spectral envelope, and obtaining a higher-band signal component through decoding; or when the higher-band information is a higher-band signal component, dividing the higher-band signal component obtained through extension into sub-bands, performing a frequency-domain higher-band parameter time-varying weighting on the coding parameter for each sub-band to obtain a time-varying fadeout spectral envelope, and obtaining a higher-band signal component through decoding.

4. An apparatus for decoding an audio signal, comprising a processor, an obtaining unit, an extending unit, a time-varying fadeout processing unit, and a synthesizing unit; wherein:

the obtaining unit is configured to obtain a lower-band signal component of an audio signal in a received code stream when the audio signal switches from a first bandwidth to a second bandwidth which is narrower than the first bandwidth, and transmit the lower-band signal component to the extending unit;

the extending unit is configured to extend the lower-band signal component to obtain higher-band information, and transmit the higher-band information obtained through extension to the time-varying fadeout processing unit;

the time-varying fadeout processing unit is configured to perform a time-varying fadeout process on the higher-band information obtained through extension to obtain a processed higher-band signal component, and transmit the processed higher-band signal component to the synthesizing unit; and the synthesizing unit is configured to synthesize the received processed hither-band signal component and the lower-band signal component obtained by the obtaining unit;

wherein the time-varying fadeout processing unit further comprises a separate processing sub-unit or a hybrid processing sub-unit; wherein:

the separate processing sub-unit is configured to perform a time-domain shaping and/or frequency-domain shaping on the higher-band signal component obtained through extension when the higher-band information obtained through extension is a higher-band signal component, and transmit the processed higher-band signal component to the synthesizing unit; and the hybrid processing sub-unit is configured to:

when the higher-band information obtained through extension is a higher-band coding parameter, perform a frequency-domain shaping on the higher-band coding parameter obtained through extension; or when the higher-band information obtained through extension is a higher-band signal component divide the higher-band signal component obtained through extension into sub-bands, perform a frequency-domain shaping on the coding parameter for each sub-band, and transmit the processed higher-band signal component to the synthesizing unit;

wherein the separate processing sub-unit further comprises at least one of a first sub-unit, a second sub-unit, a third sub-unit, and a fourth sub-unit; wherein:

the first sub-unit is configured to perform a time-domain shaping on the higher-band signal component obtained through extension by using a time-domain gain factor, and transmit the processed higher-band signal component to the synthesizing unit;

the second sub-unit is configured to perform a frequency-domain shaping on the higher-band signal component obtained through extension by using time-varying filtering, and transmit the processed higher-band signal component to the synthesizing unit;

the third sub-unit is configured to perform a time-domain shaping on the higher-band signal component obtained through extension by using a time-domain gain factor, perform a frequency-domain shaping on the time-domain shaped higher-band signal component by using time-varying filtering, and transmit the processed higher-band signal component to the synthesizing unit; and the fourth sub-unit is configured to perform a frequency-domain shaping on the higher-band signal component obtained through extension by using time-varying filtering, perform a time-domain shaping on the frequency-domain shaped higher-band signal component by using a time-domain gain factor, and transmit the processed higher-band signal component to the synthesizing unit.

* * * * *